US008169144B2

(12) United States Patent
Kim et al.

(10) Patent No.: US 8,169,144 B2
(45) Date of Patent: May 1, 2012

(54) PLASMA DISPLAY PANEL

(75) Inventors: Younjin Kim, Gumi (KR); Jonghwa Baek, Gumi (KR); Hungun Park, Gumi (KR); Jain Goo, Gumi (KR); Wontae Kim, Gumi (KR); Sangyong Lee, Gumi (KR)

(73) Assignee: LG Electronics Inc., Seoul (KR)

( * ) Notice: Subject to any disclaimer, the term of this patent is extended or adjusted under 35 U.S.C. 154(b) by 8 days.

(21) Appl. No.: 12/694,478

(22) Filed: Jan. 27, 2010

(65) Prior Publication Data

US 2010/0237776 A1 Sep. 23, 2010

(30) Foreign Application Priority Data

Mar. 20, 2009 (KR) ..... 10-2009-0024078
Mar. 20, 2009 (KR) ..... 10-2009-0024079

(51) Int. Cl.
*H01J 17/49* (2012.01)

(52) U.S. Cl. ..... 313/587; 313/586
(58) Field of Classification Search ..... 313/582–587
See application file for complete search history.

(56) References Cited

U.S. PATENT DOCUMENTS 6,236,159 B1 * 5/2001 Inoue et al. ..... 313/582
2004/0121697 A1 * 6/2004 Kojima ..... 445/24

* cited by examiner

*Primary Examiner* — Bumsuk Won
(74) *Attorney, Agent, or Firm* — KED & Associates LLP

(57) ABSTRACT

A plasma display panel is disclosed. The plasma display panel includes a front substrate, a rear substrate opposite the front substrate, a barrier rib that is positioned between the front substrate and the rear substrate to provide a discharge cell, a seal layer that attaches the front substrate to the rear substrate, and an exhaust hole that is formed on the rear substrate in a portion between the barrier rib and the seal layer. The exhaust hole is positioned in a portion overlapping an active area along a shorter side or a longer side of the rear substrate.

10 Claims, 31 Drawing Sheets

(b)

(a)

(a)

(b)

(a)

(b)

PLASMA DISPLAY PANEL

This application claims the benefit of Korean Patent Application Nos. 10-2009-0024078 filed on Mar. 20, 2009 and 10-2009-0024079 filed on Mar. 20, 2009, the entire contents of which is incorporated herein by reference for all purposes as if fully set forth herein.

BACKGROUND OF THE INVENTION

1. Field of the Invention

Embodiments of the invention relate to a plasma display panel.

2. Discussion of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display panel comprising a front substrate, a rear substrate opposite the front substrate, a barrier rib that is positioned between the front substrate and the rear substrate to provide a discharge cell, a seal layer that attaches the front substrate to the rear substrate, and an exhaust hole that is formed on the rear substrate in a portion between the barrier rib and the seal layer, the exhaust hole being positioned in a portion overlapping an active area along a shorter side or a longer side of the rear substrate.

The active area may be an area on which an image is displayed.

The plasma display panel may further comprise a dummy barrier rib that is positioned between the active area and the seal layer to provide a dummy discharge cell.

The exhaust hole may be positioned in a portion overlapping an extension line of an outermost barrier rib of barrier ribs positioned parallel to the shorter side of the rear substrate. The exhaust hole may be positioned in a portion between extension lines of two outermost barrier ribs of barrier ribs positioned parallel to the shorter side of the rear substrate.

The exhaust hole may be positioned in a portion overlapping an extension line of an outermost barrier rib of barrier ribs positioned parallel to the longer side of the rear substrate. The exhaust hole may be positioned in a portion between extension lines of two outermost barrier ribs of barrier ribs positioned parallel to the longer side of the rear substrate.

The plasma display panel may further comprise a cutoff barrier rib that is positioned between the barrier rib and the seal layer to be spaced apart from the barrier rib and the seal layer. The exhaust hole may be positioned in a portion between the seal layer and the cutoff barrier rib. A portion of the cutoff barrier rib between the exhaust hole and the barrier rib may be omitted.

In another aspect, there is a plasma display panel comprising a front substrate, a rear substrate opposite the front substrate, a barrier rib positioned between the front substrate and the rear substrate, a seal layer that attaches the front substrate to the rear substrate, and an exhaust hole that is formed on the rear substrate in a portion between the barrier rib and the seal layer, a length of the exhaust hole along a longer side of the rear substrate being different from a length of the exhaust hole along a shorter side of the rear substrate. The exhaust hole may have an oval shape.

A distance between the exhaust hole and the longer side of the rear substrate may be less than a distance between the exhaust hole and the shorter side of the rear substrate, and the length of the exhaust hole along the longer side of the rear substrate may be longer than the length of the exhaust hole along the shorter side of the rear substrate. In this case, the exhaust hole may be positioned in a portion overlapping an extension line of an outermost barrier rib positioned along the shorter side of the rear substrate. The exhaust hole may be positioned in a portion between extension lines of two outermost barrier ribs positioned along the shorter side of the rear substrate. A ratio of the length of the exhaust hole along the longer side of the rear substrate to the length of the exhaust hole along the shorter side of the rear substrate may be approximately 1.3:1 to 4:1.

A distance between the exhaust hole and the shorter side of the rear substrate may be less than a distance between the exhaust hole and the longer side of the rear substrate, and the length of the exhaust hole along the shorter side of the rear substrate may be longer than the length of the exhaust hole along the longer side of the rear substrate. In this case, the exhaust hole may be positioned in a portion overlapping an extension line of an outermost barrier rib positioned along the longer side of the rear substrate. The exhaust hole may be positioned in a portion between extension lines of two outermost barrier ribs positioned along the longer side of the rear substrate. A ratio of the length of the exhaust hole along the shorter side of the rear substrate to the length of the exhaust hole along the longer side of the rear substrate may be approximately 1.3:1 to 4:1.

In another aspect, there is a plasma display panel comprising a front substrate, a rear substrate opposite the front substrate, a barrier rib positioned between the front substrate and the rear substrate, a seal layer that attaches the front substrate to the rear substrate, and an exhaust hole that is formed on the rear substrate in a portion between the barrier rib and the seal layer, the exhaust hole including a first portion parallel to a longer side of the rear substrate and a second portion parallel to a shorter side of the rear substrate. A length of the first portion may be longer than a length of the second portion. The exhaust hole may be positioned at the corner of the rear substrate.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
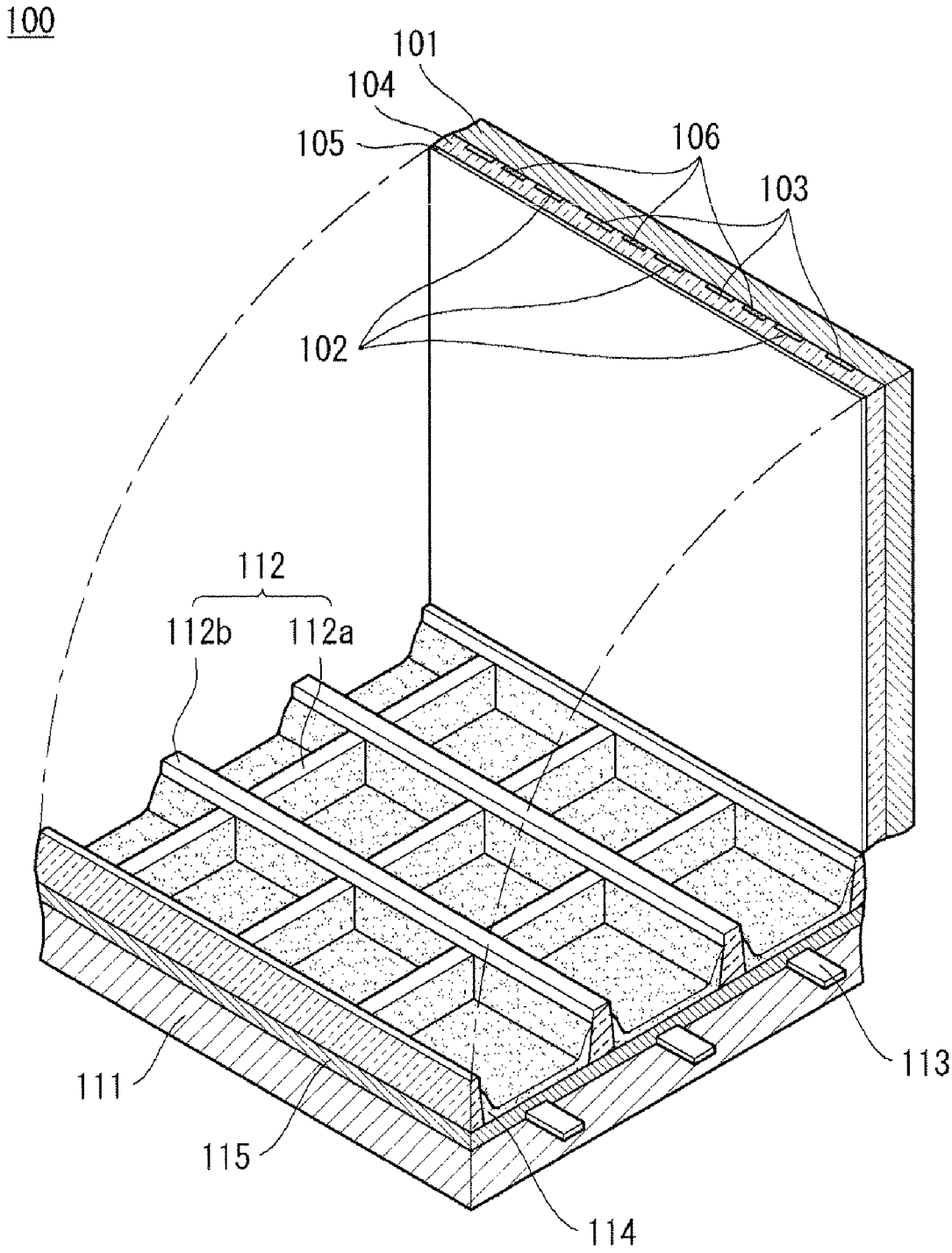
FIG. 1 illustrates an exemplary structure of a plasma display panel according to an embodiment of the invention.

FIG. 1 illustrates an exemplary structure of a plasma display panel according to an embodiment of the invention.

As shown in FIG. 1, a plasma display panel 100 may include a front substrate 101, on which a plurality of display electrodes 102 and 103 are positioned, and a rear substrate 111 on which a plurality of address electrodes 113 are positioned to cross the display electrodes 102 and 103. Each of the display electrodes 102 and 103 may include a scan electrode 102 and a sustain electrode 103.

An upper dielectric layer 104 may be formed on the scan electrode 102 and the sustain electrode 103 to limit a discharge current of the scan electrode 102 and the sustain electrode 103 and to provide insulation between the scan electrode 102 and the sustain electrode 103. A protective layer 105 may be formed on the upper dielectric layer 104 to facilitate discharge conditions. The protective layer 105 may be formed of a material having a high secondary electron emission coefficient, for example, magnesium oxide (MgO).

A lower dielectric layer 115 may be formed on the address electrode 113 to provide insulation between the address electrodes 113.

Barrier ribs 112 of a stripe type, a well type, a delta type, a honeycomb type, etc. may be formed on the lower dielectric layer 115 to partition a discharge space (i.e., a discharge cell). Hence, a first discharge cell emitting red light, a second discharge cell emitting blue light, and a third discharge cell emitting green light, etc. may be formed between the front substrate 101 and the rear substrate 111.

Each of the barrier ribs 112 may include a first barrier rib 112*a* and a second barrier rib 112*b* crossing each other. A height of the first barrier rib 112*a* may be different from a height of the second barrier rib 112*b*. The first barrier rib 112*a* may be positioned parallel to the scan electrode 102 and the sustain electrode 103, and the second barrier rib 112*b* may be positioned parallel to the address electrode 113. The height of the first barrier rib 112*a* may be less than the height of the second barrier rib 112*b*. Hence, an impurity gas inside the plasma display panel 100 may be efficiently exhausted to the outside in an exhaust process and a process for inserting a discharge gas, and the discharge gas may be uniformly diffused into the plasma display panel 100.

Each of the discharge cells partitioned by the barrier ribs 112 may be filled with a predetermined discharge gas.

A phosphor layer 114 may be formed inside the discharge cells to emit visible light for an image display during an address discharge. For example, first, second, and third phosphor layers that respectively generate red, blue, and green light may be formed inside the discharge cells.

Although the embodiment of the invention illustrates the upper dielectric layer 104 having a single-layered structure and the lower dielectric layer 115 having a single-layered structure, at least one of the upper dielectric layer 104 and the lower dielectric layer 115 may have a multi-layered structure.

While the address electrode 113 may have a substantially constant width or thickness, a width or thickness of the address electrode 113 inside the discharge cell may be different from a width or thickness of the address electrode 113 outside the discharge cell. For example, a width or thickness of the address electrode 113 inside the discharge cell may be greater than a width or thickness of the address electrode 113 outside the discharge cell.

When a predetermined signal is supplied to at least one of the scan electrode 102, the sustain electrode 103, and the address electrode 113, a discharge may occur inside the discharge cell. The discharge may allow the discharge gas filled in the discharge cell to generate ultraviolet rays. The ultraviolet rays may be incident on phosphor particles of the phosphor layer 114, and then the phosphor particles may emit visible light. Hence, an image may be displayed on the screen of the plasma display panel 100.

Figure 2:
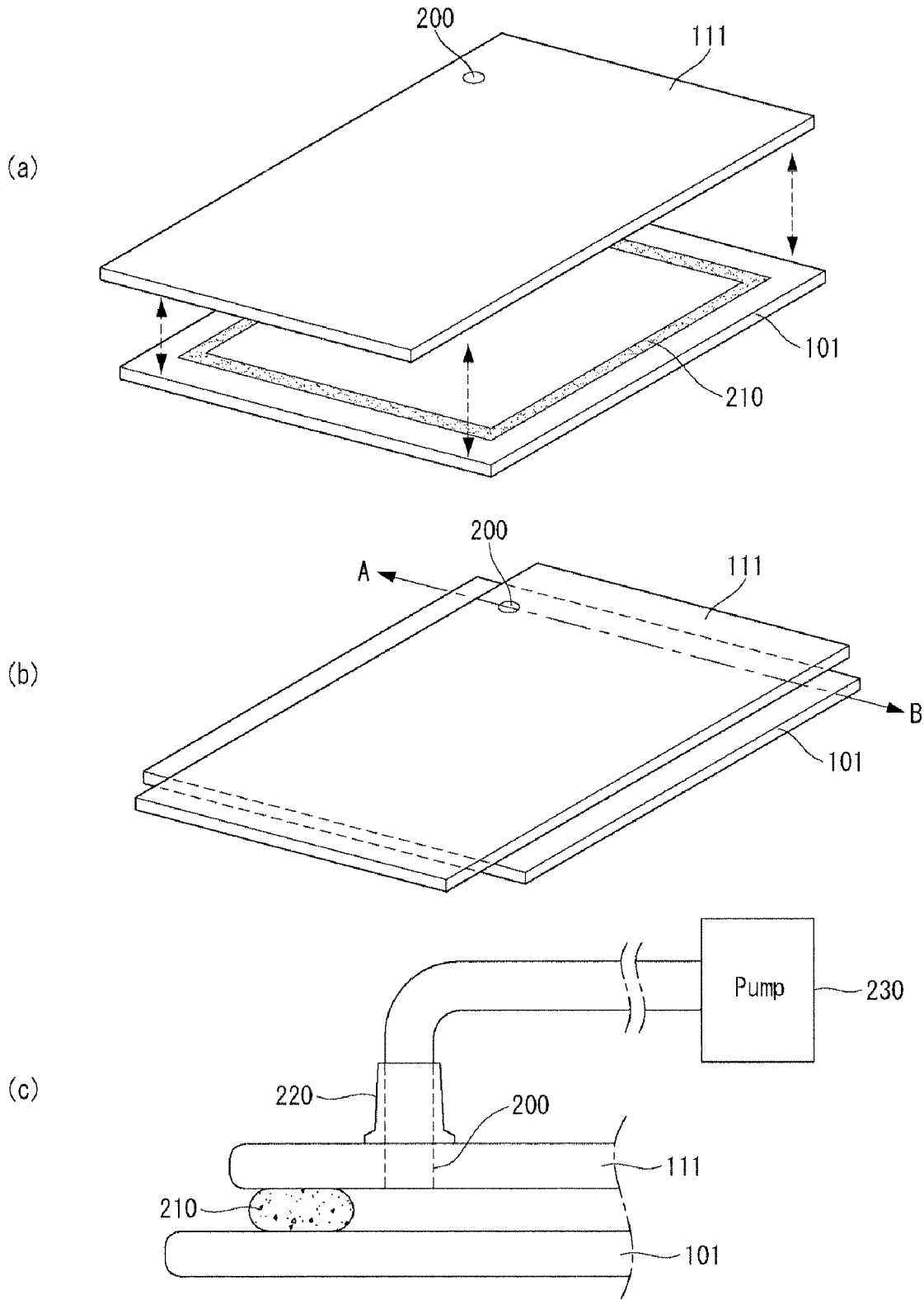
FIG. 2 illustrates an exemplary method of manufacturing a plasma display panel.

FIG. 2 illustrates an exemplary method of manufacturing the plasma display panel.

First, as shown in (a) of FIG. 2, a seal layer 210 may be formed at an edge of at least one of the front substrate 101 and the rear substrate 111 on which an exhaust hole 200 is formed. Hence, as shown in (b) of FIG. 2, the front substrate 101 and the rear substrate 111 may be attached to each other using the seal layer 210.

Subsequently, as shown in (c) of FIG. 2, an exhaust tip 220 may be connected to the exhaust hole 200, and an exhaust pump 230 may be connected to the exhaust tip 220. Hence, an impurity gas remaining in a discharge space between the front substrate 101 and the rear substrate 111 may be emitted to the outside using the exhaust pump 230, and a discharge gas such as argon (Ar), neon (Ne), xenon (Xe) may be injected into the discharge space using the exhaust pump 230.

FIGS. 3 to 8 illustrate a location of the exhaust hole. FIGS. 3 to 8 illustrate one exhaust hole 200 formed on the rear substrate 111. However, the exhaust hole 200 may be formed on the front substrate 101 and a plurality of exhaust holes may be formed. Further, the exhaust hole 200 may be formed on both the front substrate 101 and the rear substrate 111.

Figure 3:
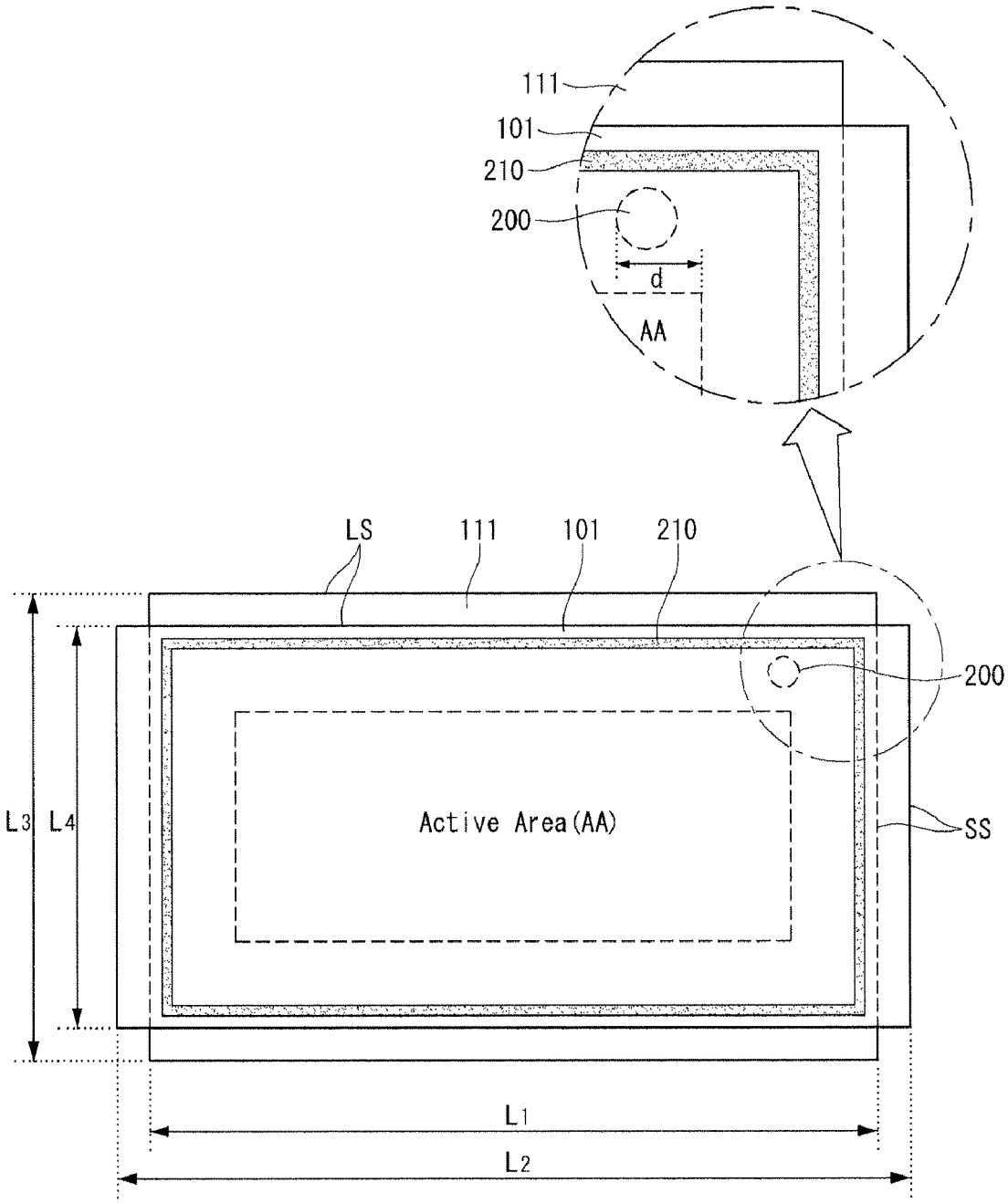
FIGS. 3 to 8 illustrate a location of an exhaust hole.

As shown in FIG. 3, the exhaust hole 200 may be formed in a portion of the rear substrate 111 overlapping an active area AA along a longer side LS or a shorter side SS of the rear substrate 111. For example, the exhaust hole 200 may be formed along the longer side LS of the rear substrate 111 at a location spaced apart from an end of the active area AA by a distance "d".

In the embodiment, the active area AA may be an area on which an image is displayed. A dummy area may be positioned outside the active area AA.

A length of the longer side LS of the rear substrate 111 may be L1, and a length of the shorter side SS of the rear substrate 111 may be L3 less than L1. Further, a length of a longer side LS of the front substrate 101 may be L2 greater than L1, and a length of a shorter side SS of the front substrate 101 may be L4 less than L3. In other words, the longer side LS of the front substrate 101 may be longer than the longer side LS of the rear substrate 111, and the shorter side SS of the rear substrate 111 may be longer than the shorter side SS of the front substrate 101. As above, a reason why the size of the front substrate 101 and the size of the rear substrate 111 disagree with each other is to electrically connect a driving element supplying a driving signal to the plasma display panel 100 to the scan electrode, the sustain electrode, or the address electrode.

As above, when the exhaust hole 200 is formed to overlap the active area AA along the longer side LS or the shorter side SS of the rear substrate 111, an exhaust characteristic of the exhaust hole 200 may be improved in an exhaust process and the size of a bezel may be reduced.

Figure 4:
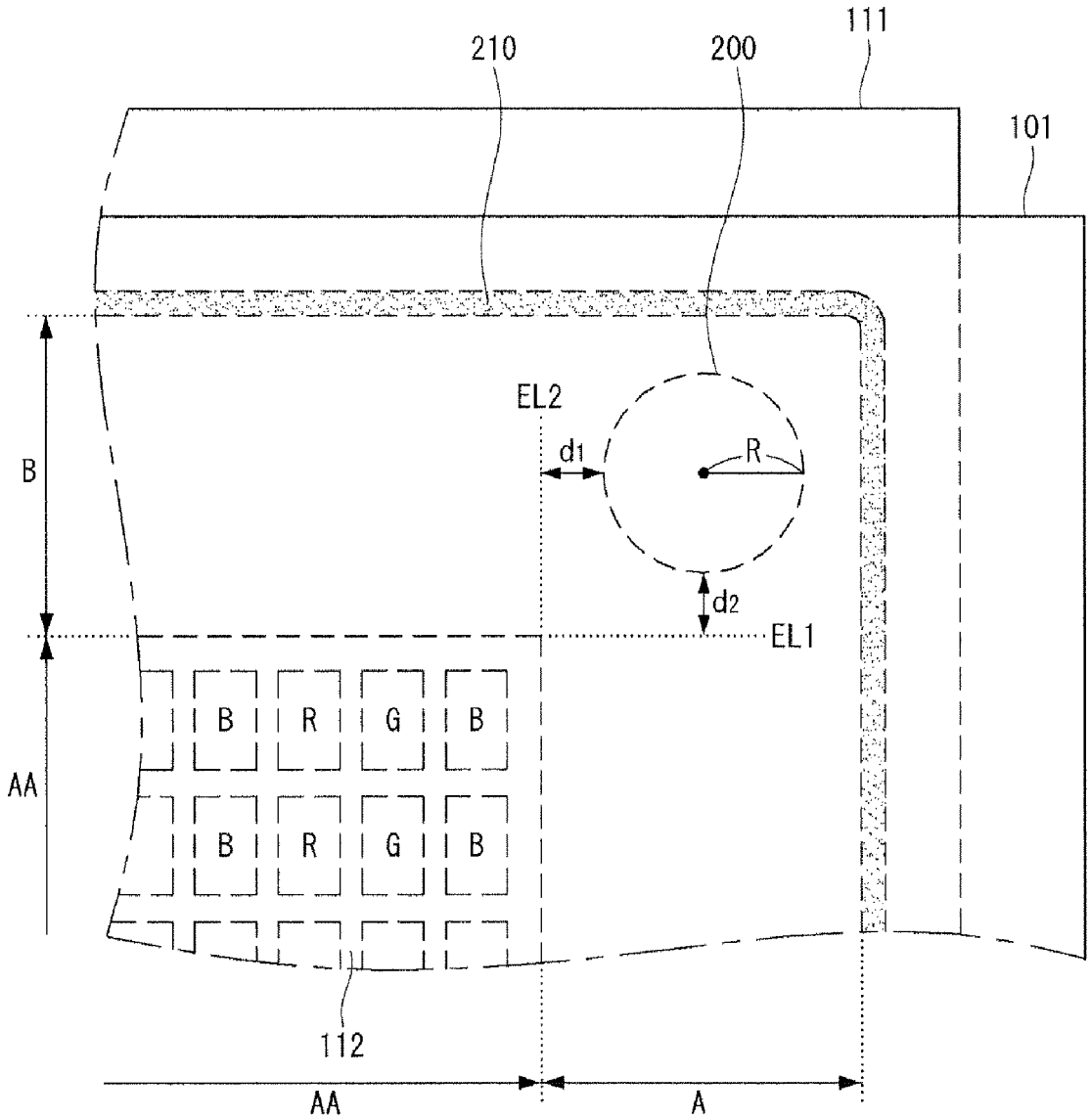

As shown in FIG. 4, it is assumed that the exhaust hole 200 has a circle shape of a radius R and is need at a location that is spaced apart from an extension line EL1 of a longer side of the active area AA by a distance d2 and from an extension line EL2 of a shorter side of the active area AA by a distance d1.

Because the exhaust hole 200 is used as a path to emit the impurity gas of the discharge space to the outside and to inject the discharge gas into the discharge space, the exhaust hole 200 has to be positioned between the seal layer 210 and the barrier rib 112 to be spaced apart from the seal layer 210 by the distances d1 and d2. Hence, a distance "A" between the seal layer 210 and the barrier rib 112 along the longer side LS of the front substrate 101 or the rear substrate 111 and a distance "B" between the seal layer 210 and the barrier rib 112 along the shorter side SS of the front substrate 101 or the rear substrate 111 may relatively increase. As a result, because the size of an unnecessary area for the image display, i.e., the size of the bezel greatly increases, an increase in the manufacturing cost may be caused.

Figure 5:
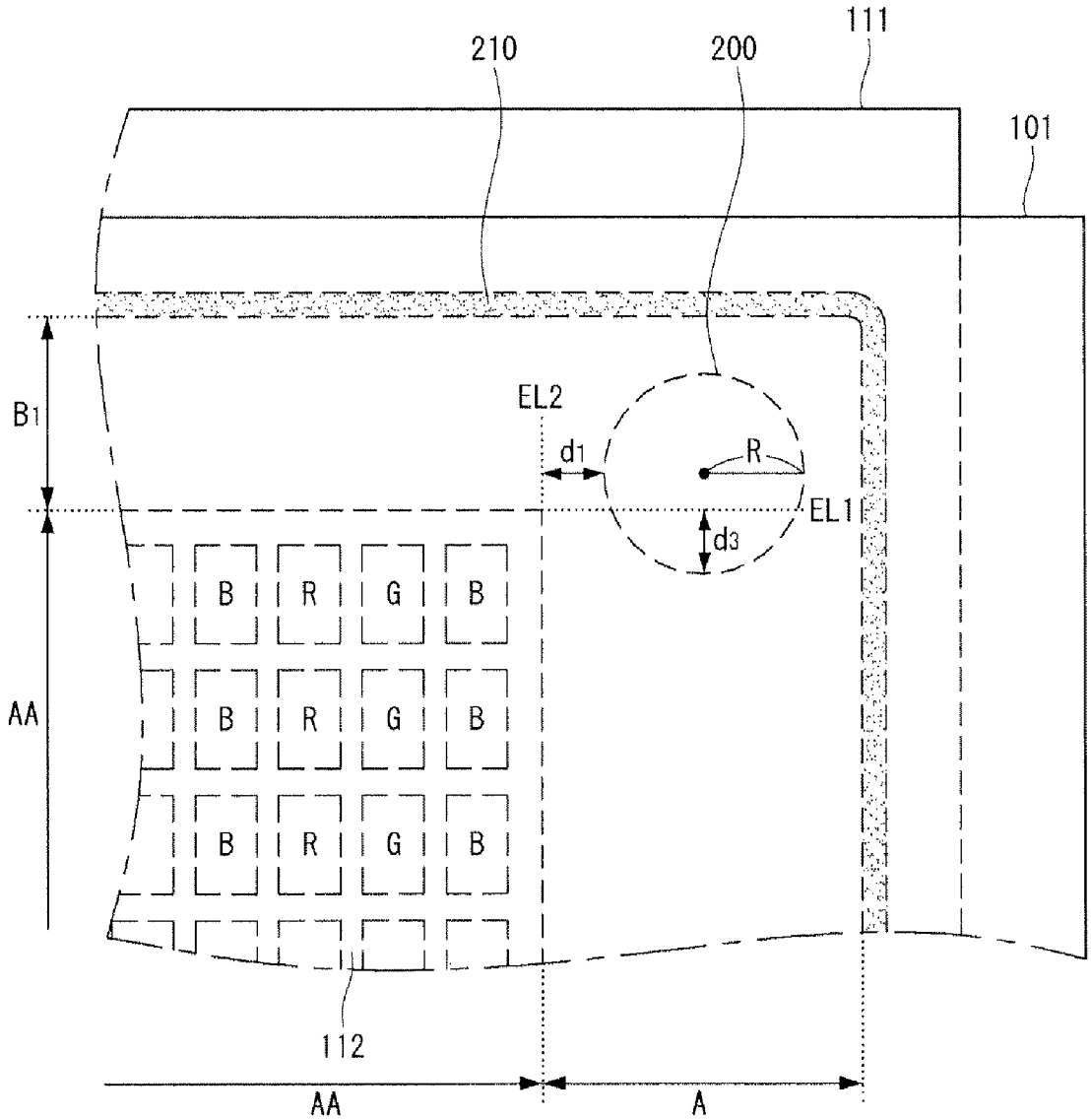

On the other hand, as shown in FIG. 5, when the exhaust hole 200 is positioned along the shorter side SS of the rear substrate 111 and partially overlaps the extension line EL1 of the longer side of the active area AA, a distance B1 between the seal layer 210 and the barrier rib 112 along the shorter side of the front substrate 101 or the rear substrate 111 may be less than the distance B of FIG. 4 by the size of an overlap portion between the exhaust hole 200 and the active area AA. In FIG. 5, the exhaust hole 200 may overlap the active area AA by a distance d3.

Because the total size of the exhaust hole 200 of FIG. 5 may be substantially equal to the total size of the exhaust hole 200 of FIG. 4, exhaust characteristic of the exhaust hole 200 of FIG. 5 may be substantially the same as or more excellent than exhaust characteristic of the exhaust hole 200 of FIG. 4. Further, in FIG. 5, the bezel size may be reduced while improving the exhaust characteristic of the exhaust hole 200. Hence, the manufacturing cost may be reduced, and an appearance of the plasma display panel 100 may be improved in a design aspect.

Further, in FIG. 5, the exhaust hole 200 may be positioned in a portion overlapping an extension line EL1 of an outermost barrier rib of the barrier ribs 112 positioned parallel to the longer side LS of the rear substrate 111.

FIG. 5 illustrates that the extension line EL1 of the longer side of the active area AA is substantially the same as the extension line EL1 of the outermost barrier rib 112 positioned parallel to the longer side LS of the rear substrate 111. In other words, in FIG. 5, the extension line EL1 of the outermost barrier rib 112 positioned parallel to the longer side LS of the rear substrate 111 is an extension line of a barrier rib formed in an outermost portion of the active area AA among the barrier ribs 112 positioned parallel to the longer side LS of the rear substrate 111.

Figure 6:
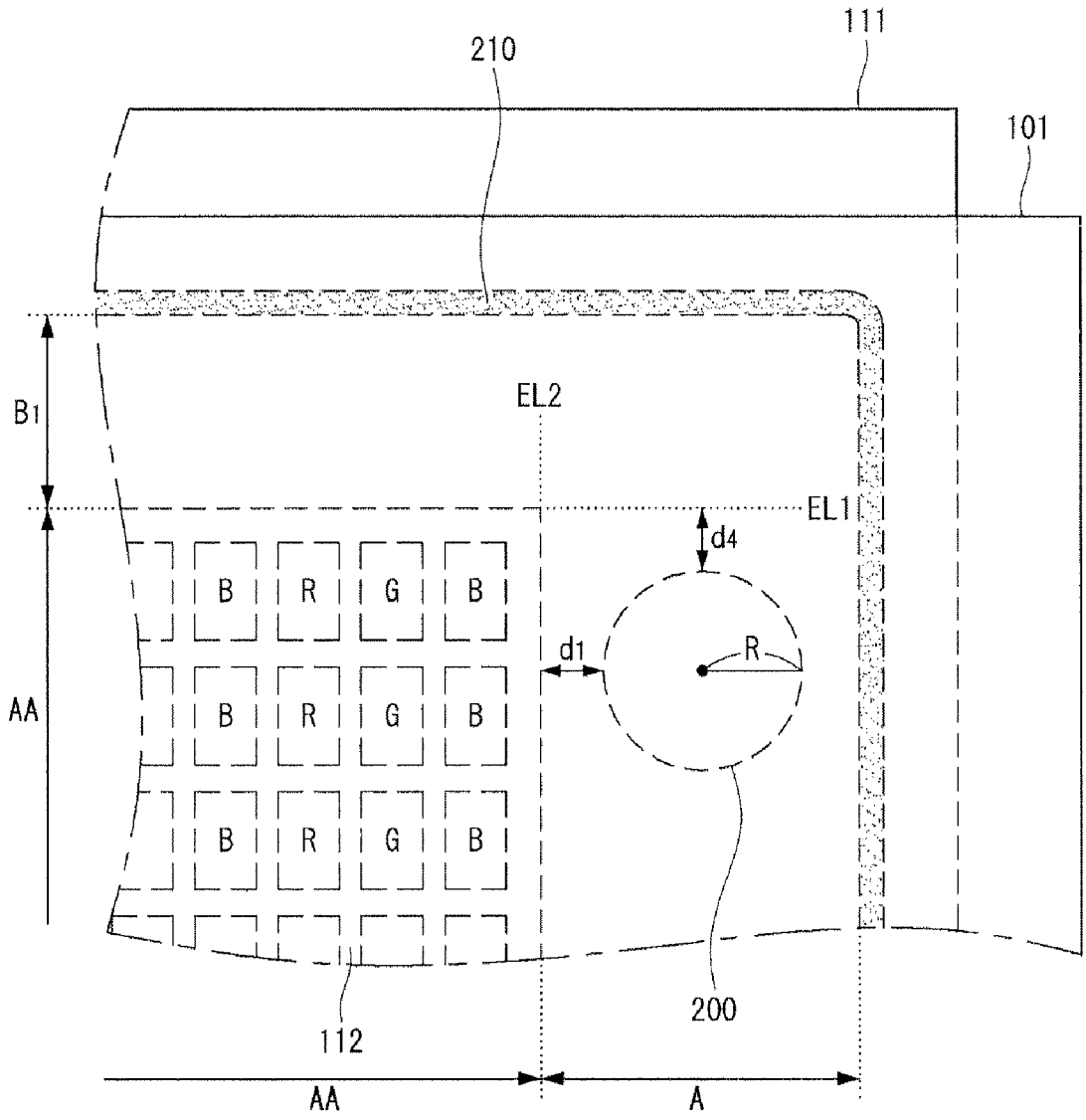

Alternatively, as shown in FIG. 6, the exhaust hole 200 may be positioned in a portion between the extension lines EL1 of two outermost barrier ribs of the barrier ribs positioned parallel to the longer side LS of the rear substrate 111. In other words, because the exhaust hole 200 is positioned in a portion entirely overlapping the active area AA along the shorter side SS of the rear substrate 111, the exhaust hole 200 may be formed at a location spaced apart from the extension lines EU of the two outermost barrier ribs positioned parallel to the longer side LS of the rear substrate 111 by a distance d4. In this case, the bezel size may be reduced.

Figure 7:
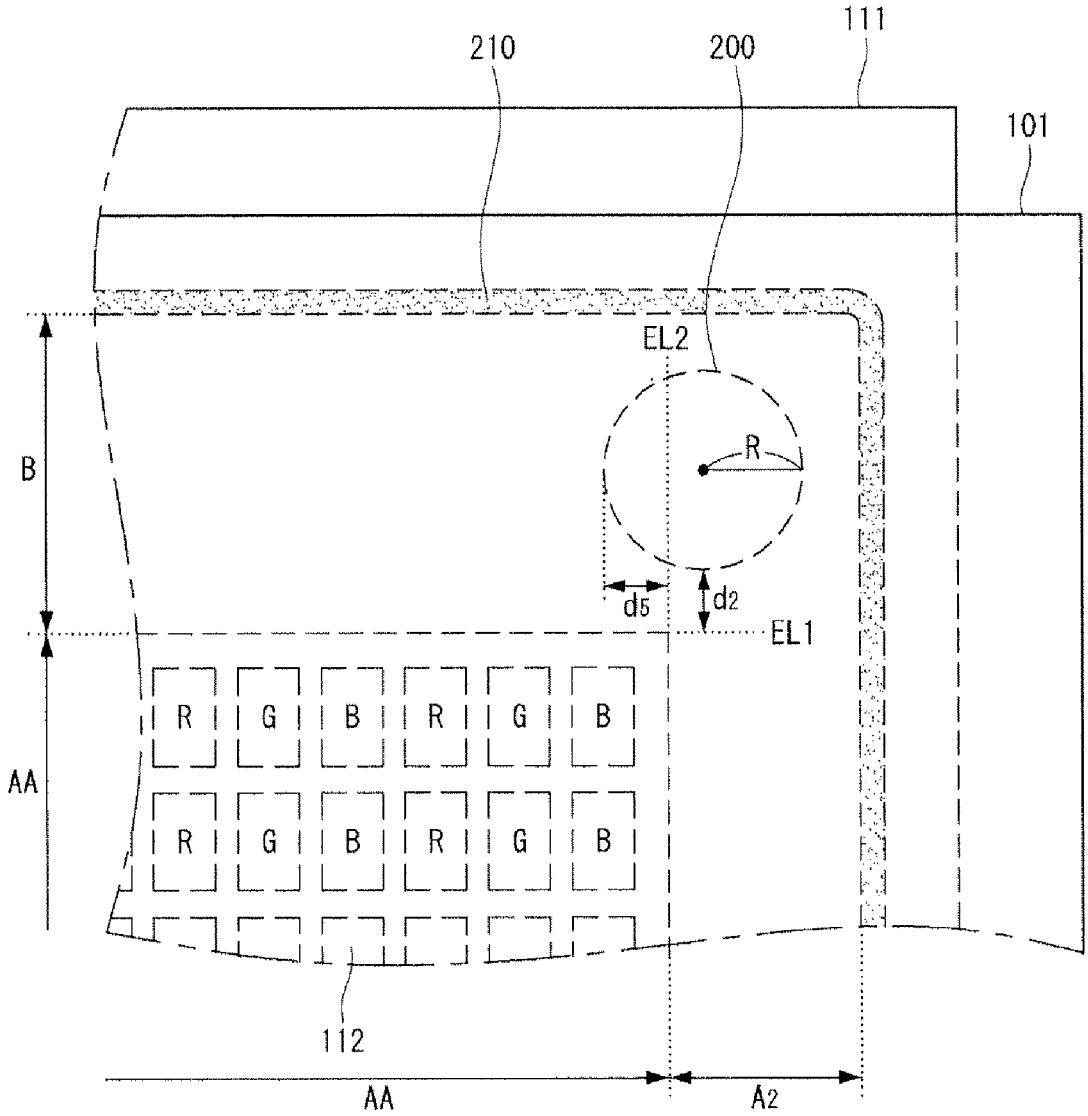

Alternatively, as shown in FIG. 7, when the exhaust hole 200 is positioned along the longer side LS of the rear substrate 111 and overlaps the active area AA (i.e., when the exhaust hole 200 partially overlaps the extension line EL2 of the shorter side of the active area AA), a distance A2 between the seal layer 210 and the barrier rib 112 may be less than the distance "A" of FIG. 4 by the size of an overlapping portion between the exhaust hole 200 and the active area AA along the longer side LS of the front substrate 101 or the rear substrate 111.

In FIG. 7, the exhaust hole 200 may overlap the active area AA by a distance d5.

The location of the exhaust hole 200 illustrated in FIG. 7 may reduce the bezel size while obtaining exhaust characteristic similar to or more excellent than the exhaust characteristic obtained through the location of the exhaust hole 200 illustrated in FIG. 4.

In FIG. 7, the exhaust hole 200 may be positioned in a portion overlapping an extension line EL2 of an outermost barrier rib of the barrier ribs positioned parallel to the shorter side SS of the rear substrate 111.

FIG. 7 illustrates that the extension line EL2 of the shorter side of the active area AA is substantially the same as the extension line EL2 of the outermost barrier rib 112 positioned parallel to the shorter side SS of the rear substrate 111. In other words, in FIG. 7, the extension line EL2 of the outermost barrier rib 112 positioned parallel to the shorter side SS of the rear substrate 111 is an extension line of a barrier rib formed in an outermost portion of the active area AA among the barrier ribs 112 positioned parallel to the shorter side SS of the rear substrate 111.

Figure 8:
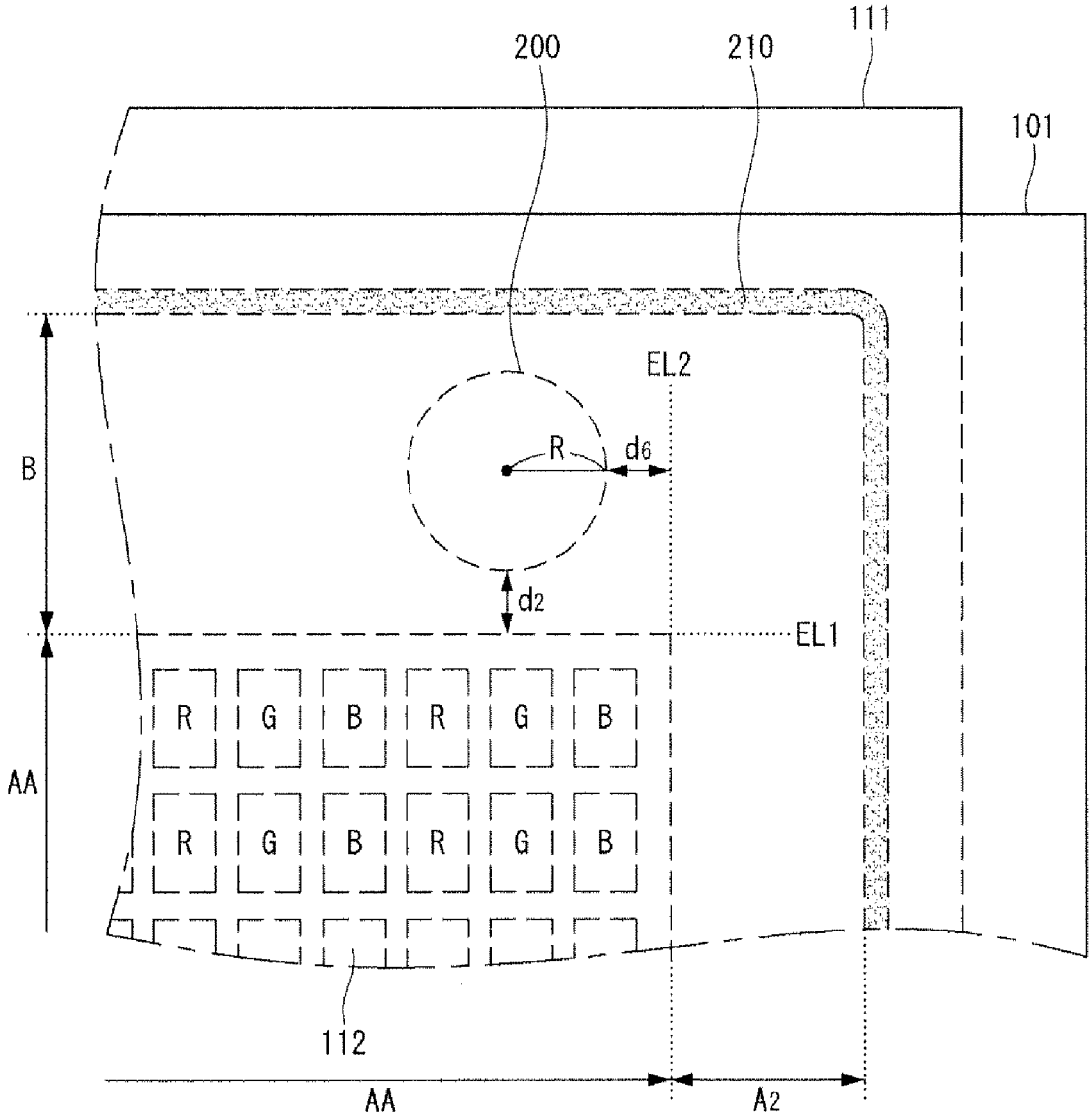

Alternatively, as shown in FIG. 8, the exhaust hole 200 may be positioned in a portion between the extension lines EL2 of two outermost barrier ribs of the barrier ribs positioned parallel to the shorter side SS of the rear substrate 111. In other words, because the exhaust hole 200 is positioned in a portion entirely overlapping the active area AA along the longer side LS of the rear substrate 111, the exhaust hole 200 may be formed at a location spaced apart from the extension line EL1 of the two outermost barrier ribs positioned parallel to the shorter side SS of the rear substrate 111 by a distance d6. In this case, the bezel size may be reduced.

Figure 9:
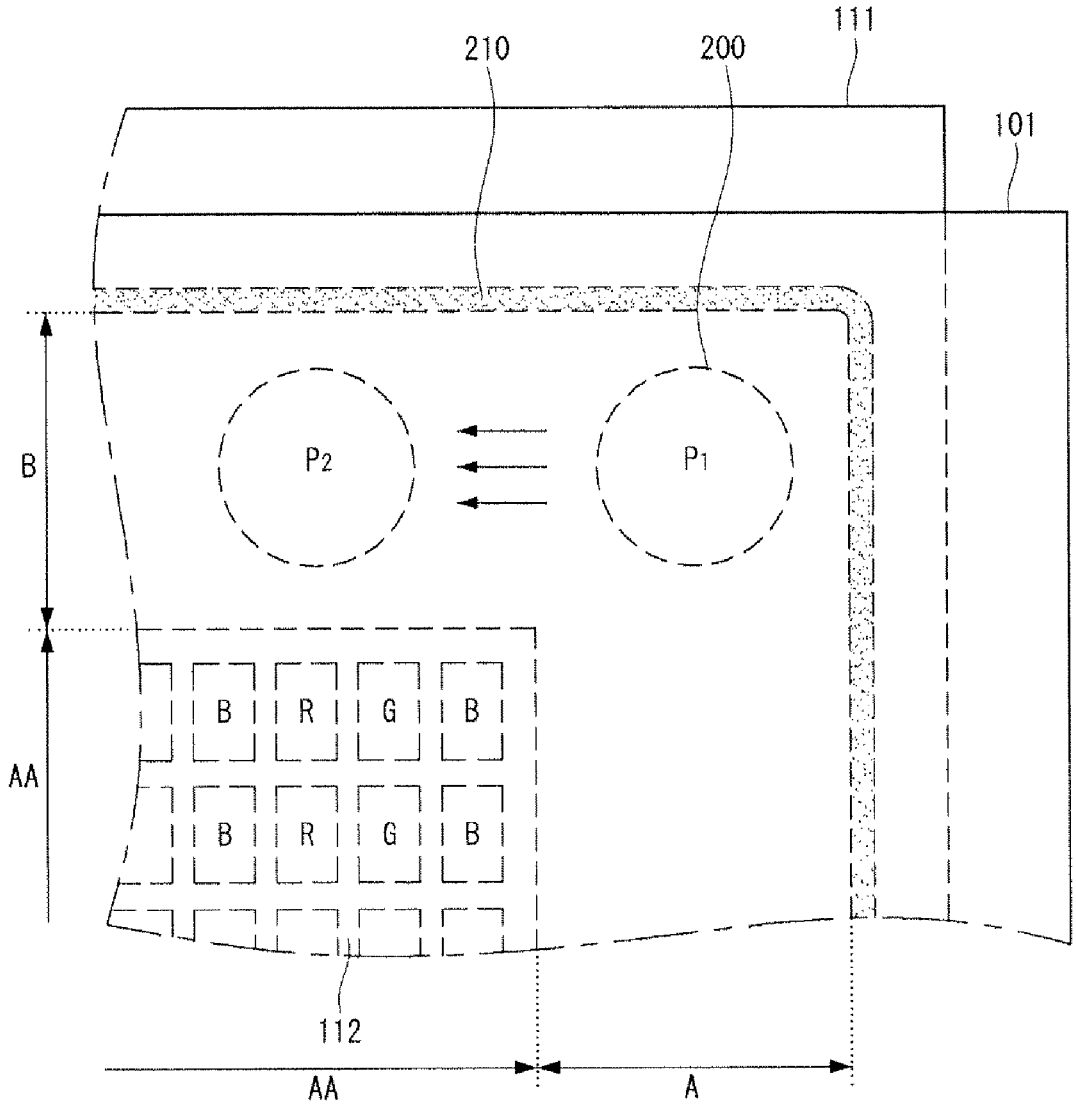
FIGS. 9 and 10 are diagrams for comparing exhaust characteristic of an embodiment of the invention with exhaust characteristic of a comparative example.
Figure 10:
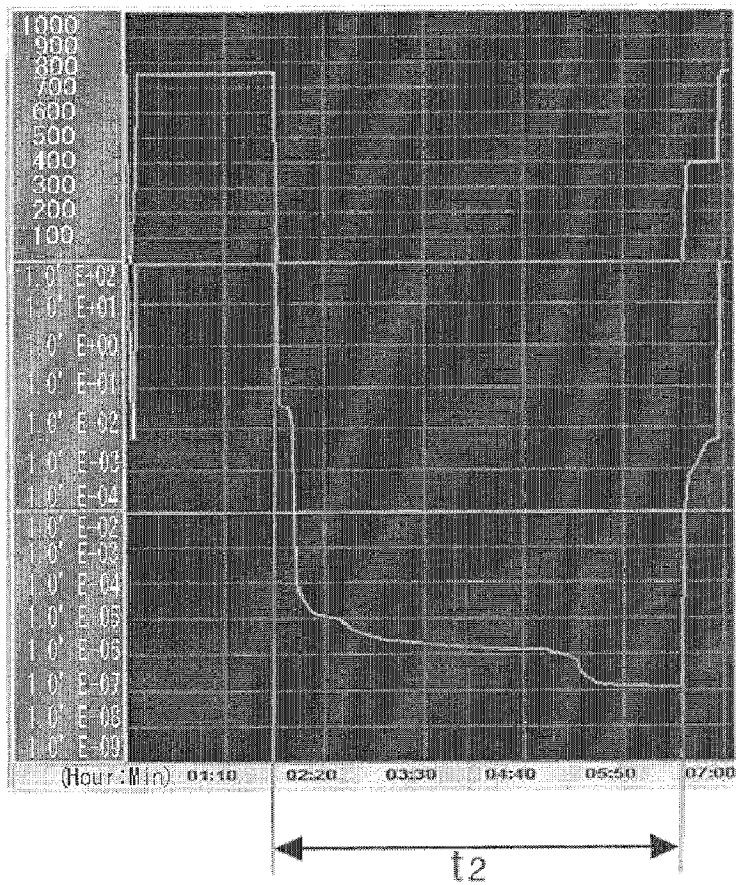
Figure 10:
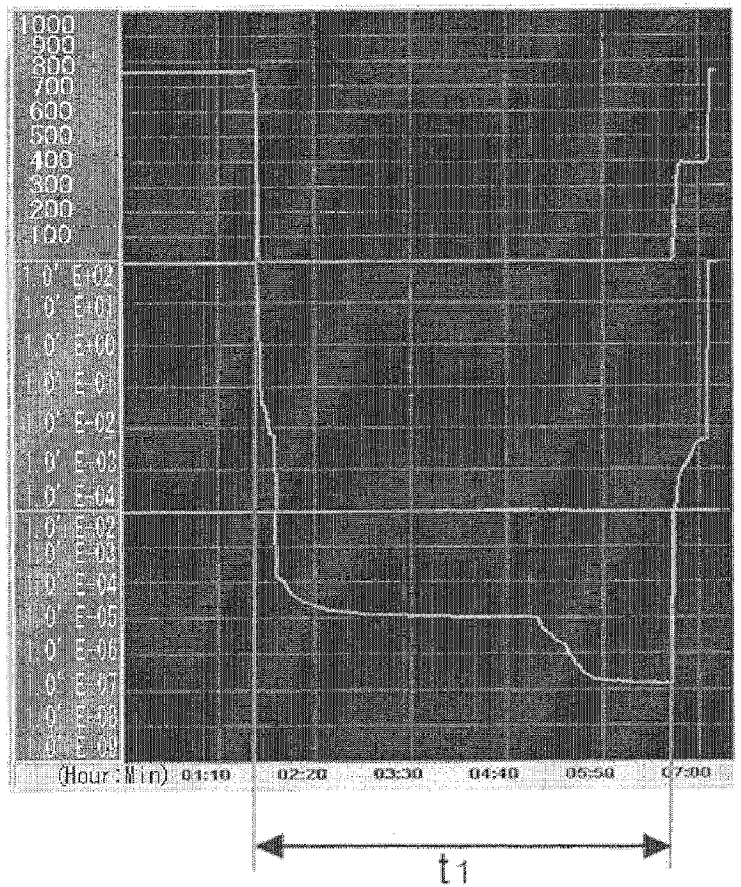

FIGS. 9 and 10 are diagrams for comparing the exhaust characteristic of the embodiment of the invention with exhaust characteristic of a comparative example.

As shown in FIG. 9, in each of a comparative example in which the exhaust hole 200 is formed at a first position P1 and an exemplary embodiment of the invention in which the exhaust hole 200 is formed at a second position P2, a gas in the panel was emitted using a vacuum pump, and time required to lower an internal pressure of the panel to a critical degree of vacuum was measured. The critical degree of vacuum was set to about $2.1\times10^{-21}$ mmHg.

The exhaust hole 200 at the first position P1 does not overlap the active area AA, and the exhaust hole 200 at the second position P2 is positioned at the same location as the exhaust hole 200 illustrated in FIG. 8.

In FIG. 10, (a) illustrates a measuring result of time required to lower the internal pressure of the panel to the critical degree of vacuum in the comparative example, and (b) illustrates a measuring result of time required to lower the internal pressure of the panel to the critical degree of vacuum in the exemplary embodiment of the invention.

As shown in (a) of FIG. 10, in the comparative example, a time t1 ranging from a time point when an impurity gas in the panel starts to be sucked through the vacuum pump to a time point when the internal pressure of the panel reaches the critical degree of vacuum was approximately 300 minutes.

As shown in (b) of FIG. 10, in the exemplary embodiment of the invention, a time t2 ranging from a time point when an impurity gas in the panel starts to be sucked through the vacuum pump to a time point when the internal pressure of the panel reaches the critical degree of vacuum was approximately 285 minutes and was more reduced than the time t1 of the comparative example by about 5%.

As above, the time t2 of the exemplary embodiment of the invention is shorter than the time t1 of the comparative example, because the exhaust hole 200 changes to a location (i.e., the second position P2) overlapping the active area AA to thereby more uniformly suck the impurity gas in the panel.

More specifically, the exhaust hole 200 at the second position P2 may be closer to the middle of the panel than the exhaust hole 200 at the first position P1. Thus, the exhaust hole 200 at the second position P2 according to the exemplary embodiment of the invention may more uniformly suck the impurity gas in the panel than the exhaust hole 200 at the first position P1 according to the comparative example. Further, the manufacturing cost in the exemplary embodiment of the invention may be reduced because of a reduction in time required in an exhaust process.

Figure 11:
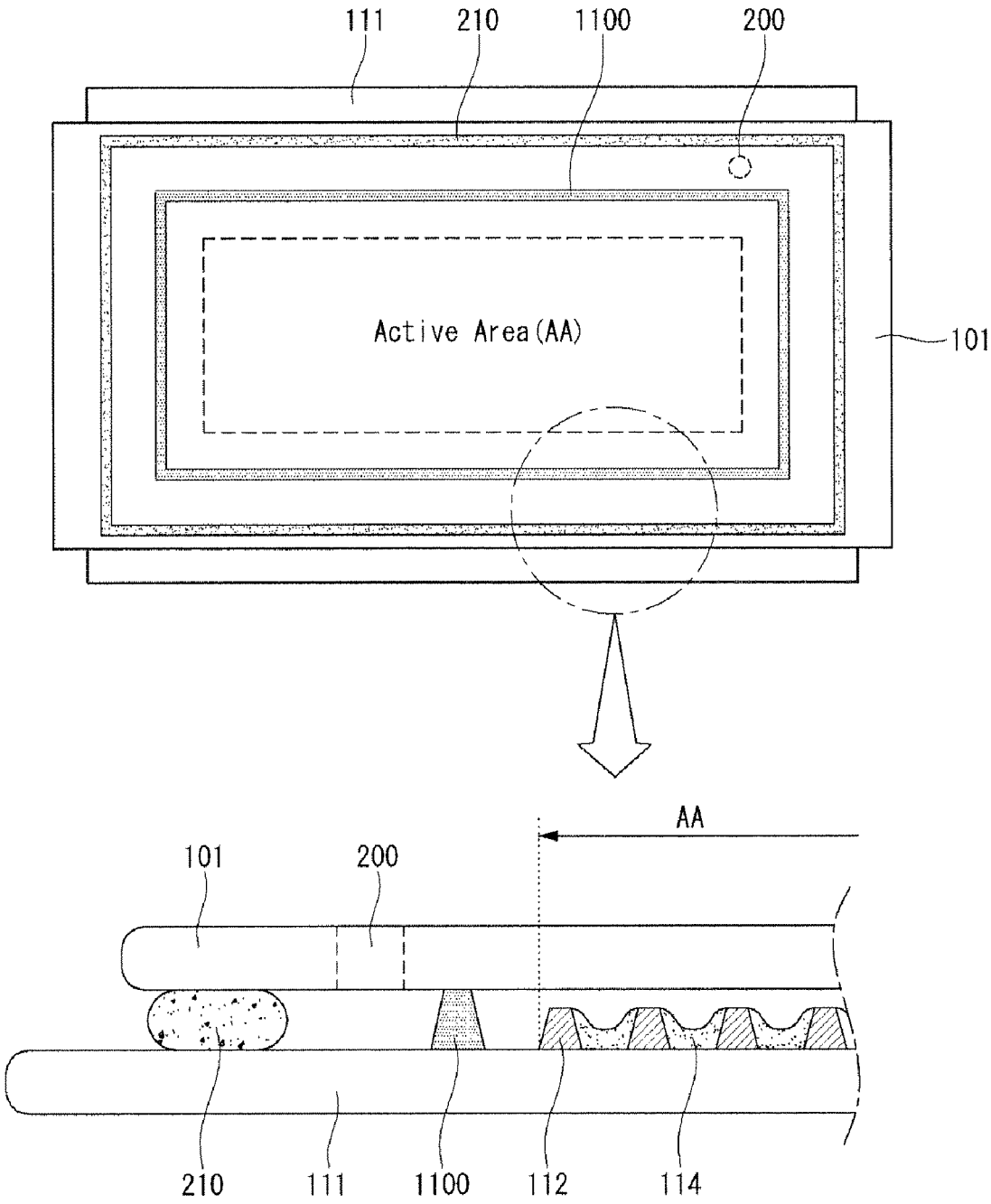
FIGS. 11 and 12 illustrate a cutoff barrier rib.
Figure 12:
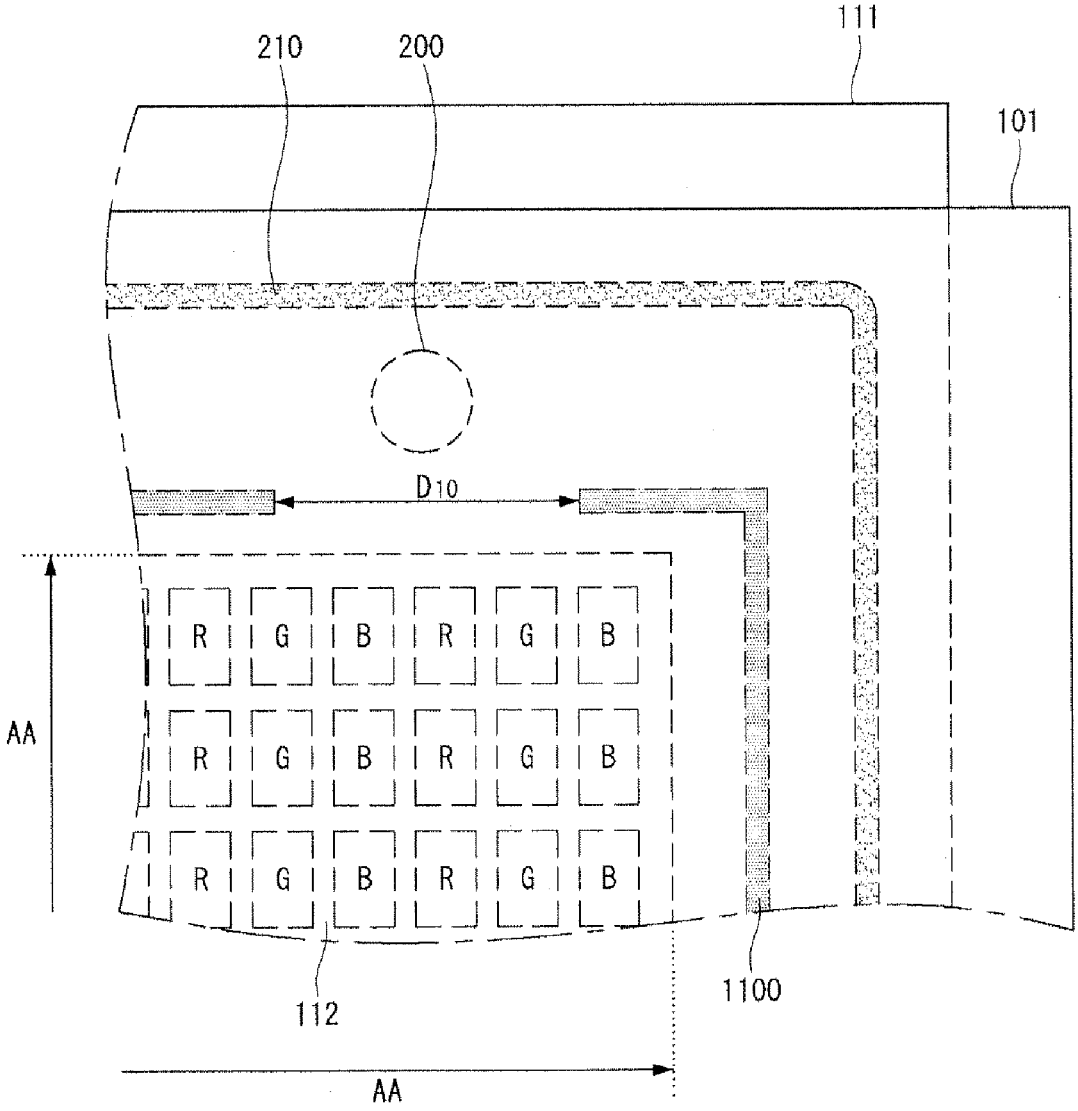

FIGS. 11 and 12 illustrate a cutoff barrier rib.

As shown in FIG. 11, a cutoff barrier rib 1100 may be positioned between the active area AA and the seal layer 210 to prevent the seal layer 210 from penetrating in the active area AA. In other words, the cutoff barrier rib 1100 may be positioned between the barrier rib 112 in the active area AA and the seal layer 210. The cutoff barrier rib 1100 may be called a seal cutoff barrier rib. Further, the cutoff barrier rib 1100 may be positioned to be spaced apart from the barrier rib 112 positioned in the active area AA.

As above, because a distance between the front substrate 101 and the rear substrate 111 is held constant through the cutoff barrier rib 1100, a noise may be reduced.

Further, a portion of the cutoff barrier rib 1100 between the exhaust hole 200 and the barrier rib 112 may be omitted. For example, as shown in FIG. 12, when the exhaust hole 200 overlaps the active area AA along the longer side LS of the rear substrate 111, a portion of the cutoff barrier rib 1100 may be omitted in an overlapping portion D10 between the exhaust hole 200 and the cutoff barrier rib 1100 along the longer side LS of the rear substrate 111. In other words, the portion of the cutoff barrier rib 1100 may be omitted, so that the cutoff barrier rib 1100 does not prevent the discharge gas from being injected into the exhaust hole 200.

As above, the gas may be injected more efficiently into the exhaust hole 200 by omitting the portion of the cutoff barrier rib 1100, and thus a reduction in the exhaust characteristic of the exhaust hole 200 may be prevented.

Figure 13:
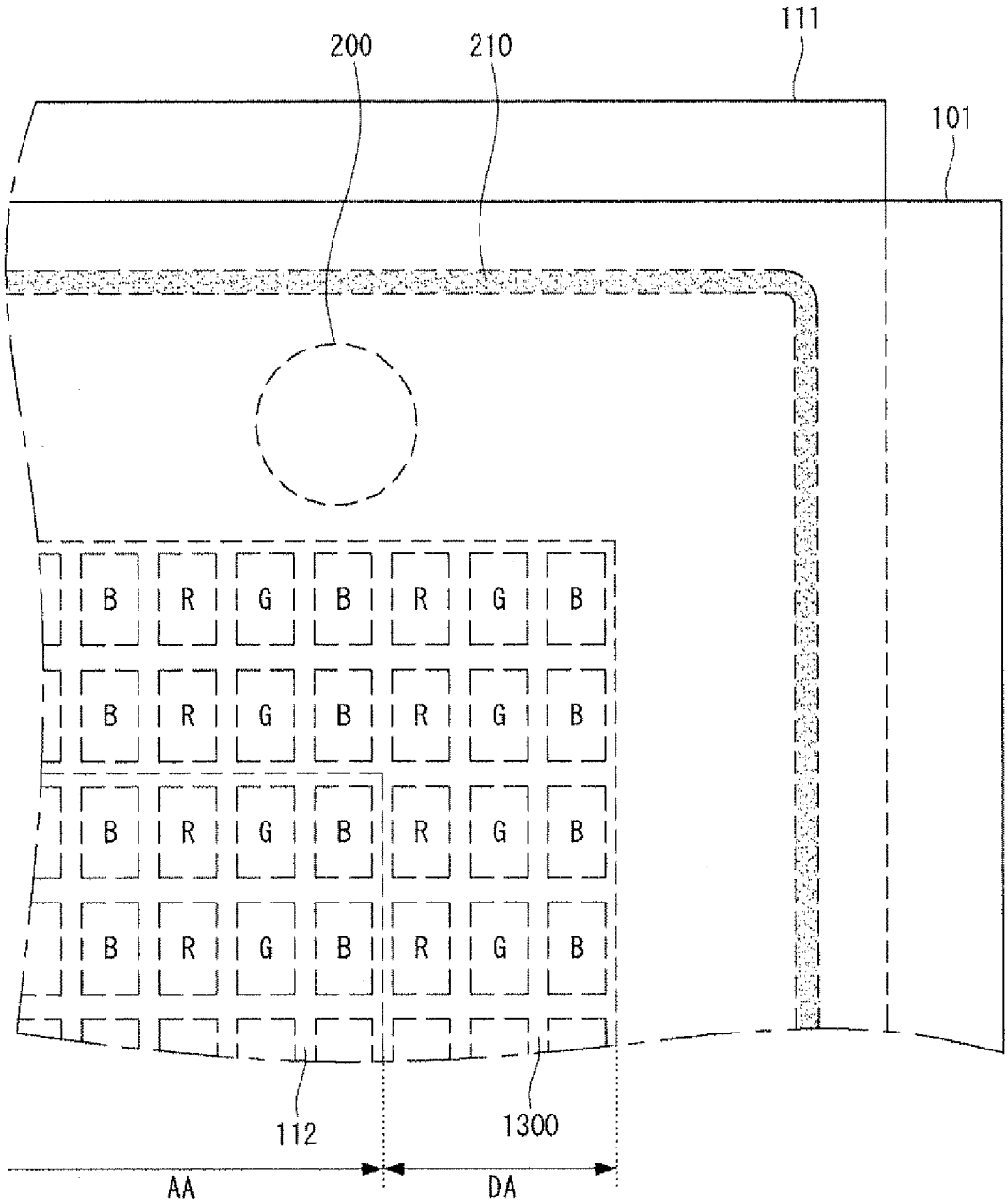
FIG. 13 illustrates a dummy area.

FIG. 13 illustrates a dummy area.

As shown in FIG. 13, a dummy area DA outside the active area AA may be positioned between the active area AA and the seal layer 210. The dummy area DA may improve discharge characteristics of the discharge cells formed in the active area AA and may improve a structural stability of the barrier ribs 112.

Further, dummy barrier ribs 1300 providing dummy discharge cells may be positioned in the dummy area DA. The dummy barrier ribs 1300 may be connected to the barrier ribs 112 formed in the active area AA.

Further, when the cutoff barrier rib (not shown in FIG. 13) is formed, the cutoff barrier rib may be positioned between the dummy barrier rib 1300 and the seal layer 210 to be spaced apart from the dummy barrier rib 1300.

When the dummy barrier ribs 1300 are formed as shown in FIG. 13, the exhaust hole 200 may overlap an extension line of an outermost dummy barrier rib 1300 or may be positioned in a portion between extension lines of two outermost dummy barrier ribs 1300. This was described in detail with reference to FIGS. 5 to 8.

FIGS. 14 to 25 illustrate various shapes of the exhaust hole 200.

Figure 14:
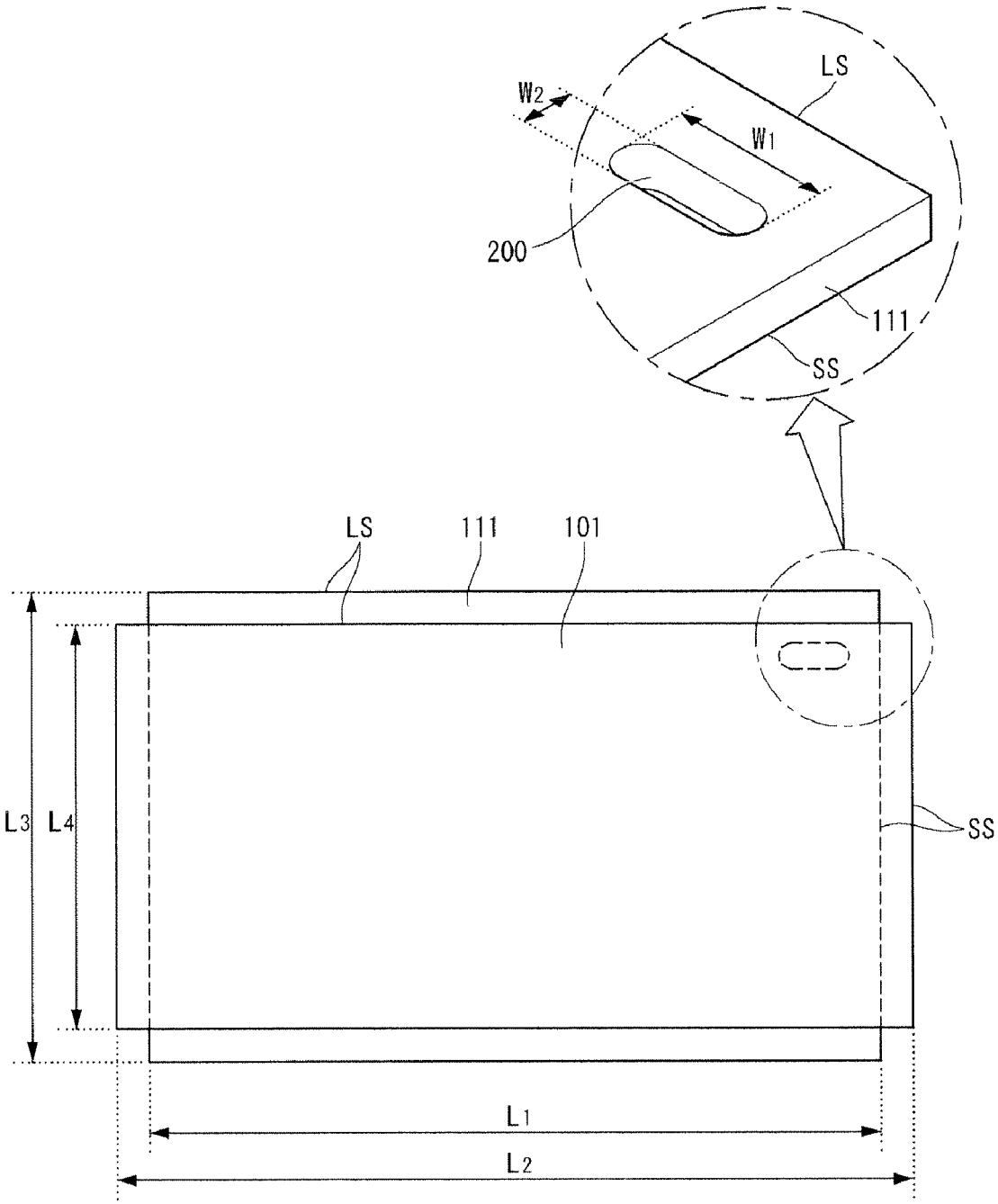
FIGS. 14 to 25 illustrate various shapes of an exhaust hole.

As shown in FIG. 14, a length W1 of the exhaust hole 200 along the longer side LS of the rear substrate 111 is different from a length W2 of the exhaust hole 200 along the shorter side SS of the rear substrate 111. For example, the exhaust hole 200 may have an oval shape. In FIG. 14, a width W1 of the exhaust hole 200 along the longer side LS of the rear substrate 111 may be called a first width W1, and a width W2 of the exhaust hole 200 along the shorter side SS of the rear substrate 111 may be called a second width W2.

As above, when the length W1 of the exhaust hole 200 along the longer side LS of the rear substrate 111 is different from the length W2 of the exhaust hole 200 along the shorter side SS of the rear substrate 111, the exhaust characteristic may be improved and the bezel size may be reduced.

Figure 15:
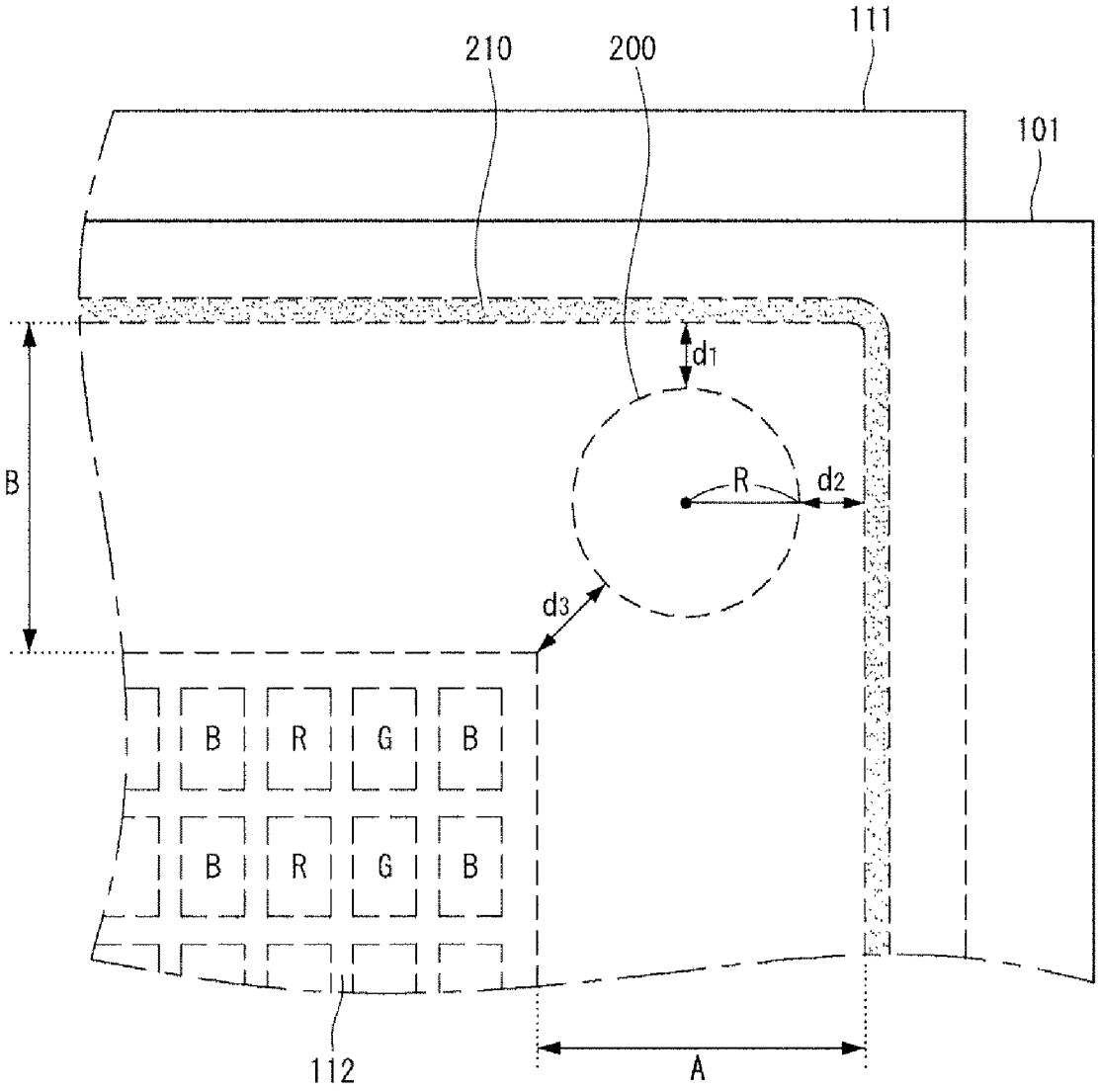

FIG. 15 illustrates the exhaust hole 200 having a circle shape of a radius R.

Because the exhaust hole 200 is used as a path to emit an impurity gas of a discharge space to the outside and to inject a discharge gas into the discharge space, the exhaust hole 200 has to be positioned between the seal layer 210 and the barrier rib 112 to be spaced apart from the seal layer 210 by distances d1 and d2. Further, the exhaust hole 200 has to be spaced apart from the barrier rib 112 by a distance d3. Hence, in case of FIG. 15, a distance A between the seal layer 210 and the barrier rib 112 along the longer side LS of the front substrate 101 or the rear substrate 111 and a distance B between the seal layer 210 and the barrier rib 112 along the shorter side SS of the front substrate 101 or the rear substrate 111 may relatively increase. As a result, because the size of an unnecessary area for the image display, i.e., the bezel size greatly increases, an increase in the manufacturing cost may be caused.

Figure 16:
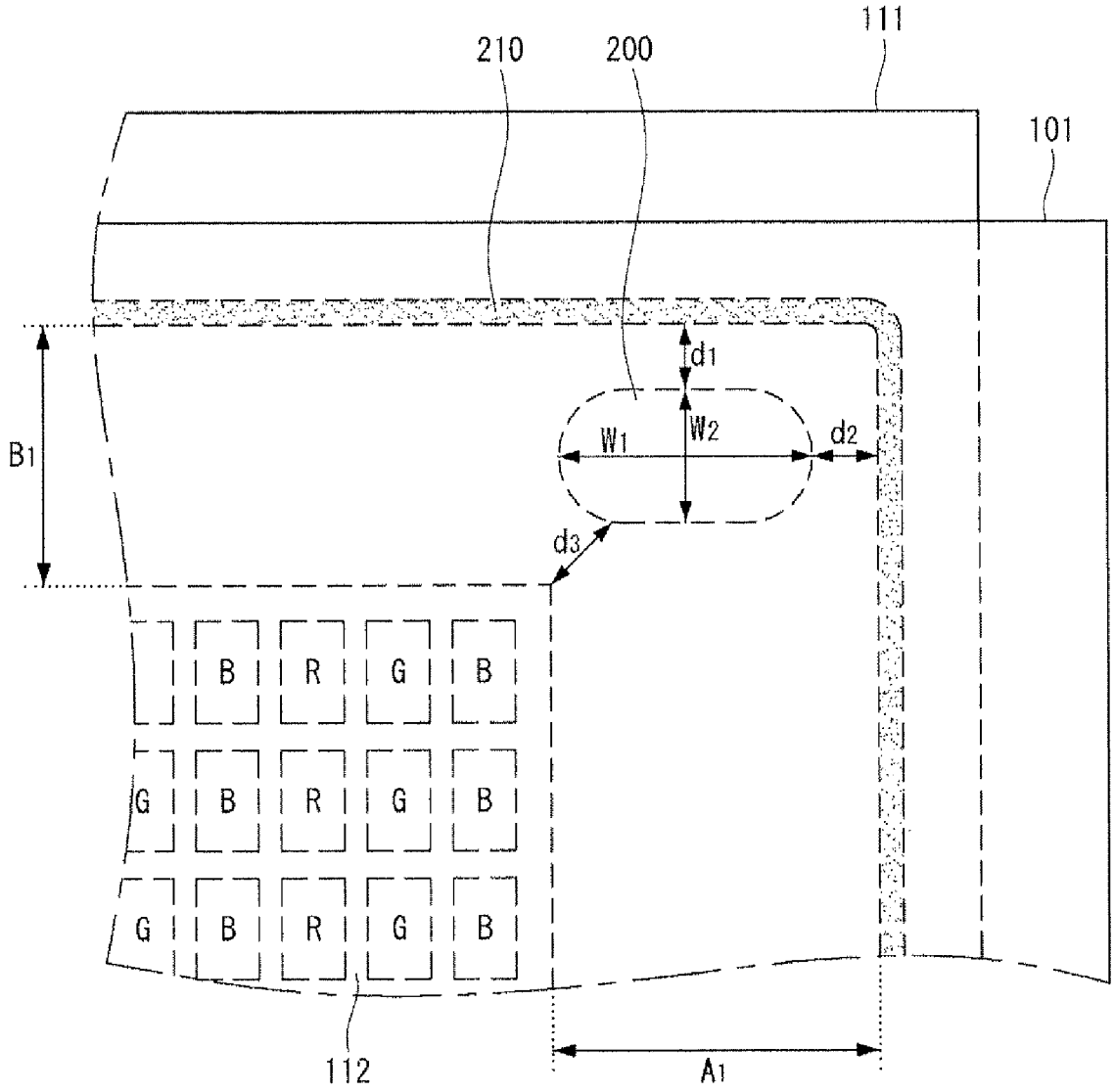

On the other hand, as shown in FIG. 16, when a width W1 of the exhaust hole 200 along the longer side LS of the rear substrate 111 is greater than a width W2 of the exhaust hole 200 along the shorter side SS of the rear substrate 111, a distance B1 between the seal layer 210 and the barrier rib 112 along the shorter side SS of the front substrate 101 or the rear substrate 111 may be less than the distance B of FIG. 15 by a reduced size of the width W2 of the exhaust hole 200 along the shorter side SS of the rear substrate 111.

Figure 17:
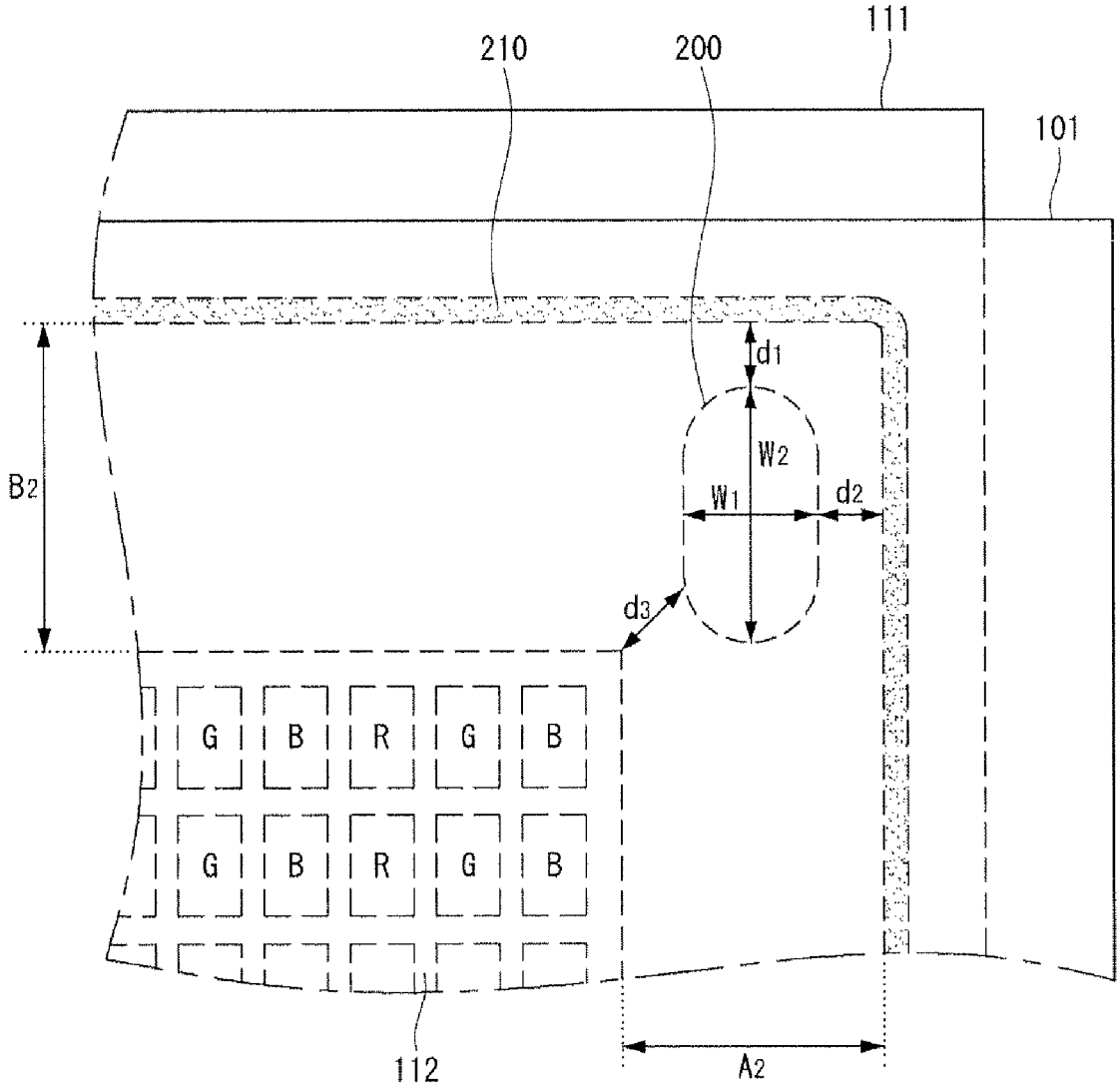

Alternatively, as shown in FIG. 17, when a width W2 of the exhaust hole 200 along the shorter side SS of the rear substrate 111 is greater than a width W1 of the exhaust hole 200 along the longer side LS of the rear substrate 111, a distance A2 between the seal layer 210 and the barrier rib 112 along the longer side LS of the front substrate 101 or the rear substrate 111 may be less than the distance A of FIG. 15 by a reduced size of the width W1 of the exhaust hole 200 along the longer side LS of the rear substrate 111.

Because the total size of the exhaust hole 200 in FIGS. 16 and 17 is substantially equal to the total size of the exhaust hole 200 in FIG. 15, the exhaust characteristic of the exhaust hole 200 in FIGS. 16 and 17 may be substantially the same as or more excellent than the exhaust characteristic of the exhaust hole 200 in FIG. 15.

As above, when the width W1 of the exhaust hole 200 along the longer side LS of the rear substrate 111 is different from the width W2 of the exhaust hole 200 along the shorter side SS of the rear substrate 111 as shown in FIGS. 16 and 17, the bezel size may be reduced while improving the exhaust characteristic of the exhaust hole 200. Hence, the manufacturing cost may be reduced, and the appearance of the plasma display panel 100 may be improved in the design aspect.

Figure 18:
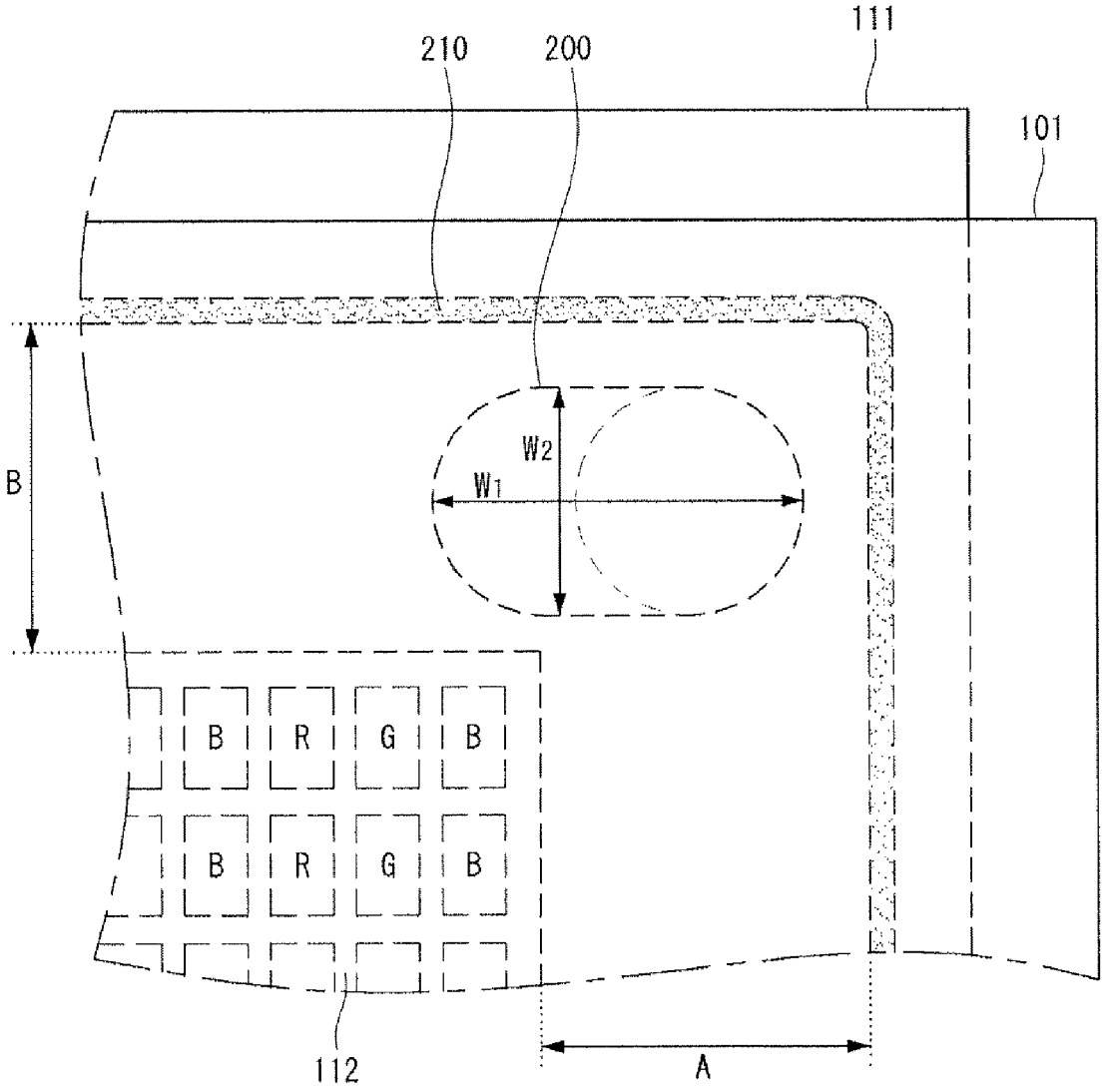

Alternatively, as shown in FIG. 18, a width W1 of the exhaust hole 200 along the longer side LS of the rear substrate 111 may be different from a width W2 of the exhaust hole 200 along the shorter side SS of the rear substrate 111 by increasing only the width W1 of the exhaust hole 200 in a state where the width W2 of the exhaust hole 200 is equal to a width (i.e., a diameter) of the exhaust hole 200 shown in FIG. 15.

In this case, a distance A between the seal layer 210 and the barrier rib 112 along the longer side LS of the front substrate 101 or the rear substrate 111 and a distance B between the seal layer 210 and the barrier rib 112 along the shorter side SS of the front substrate 101 or the rear substrate 111 may be substantially equal to the distances A and B in FIG. 15, respectively. In other words, the bezel sizes in FIGS. 15 and 18 may be substantially equal to each other. However, because the size of the exhaust hole 200 in FIG. 18 is greater than the size of the exhaust hole 200 in FIG. 15, the exhaust characteristic in FIG. 18 may be further improved.

Figure 19:
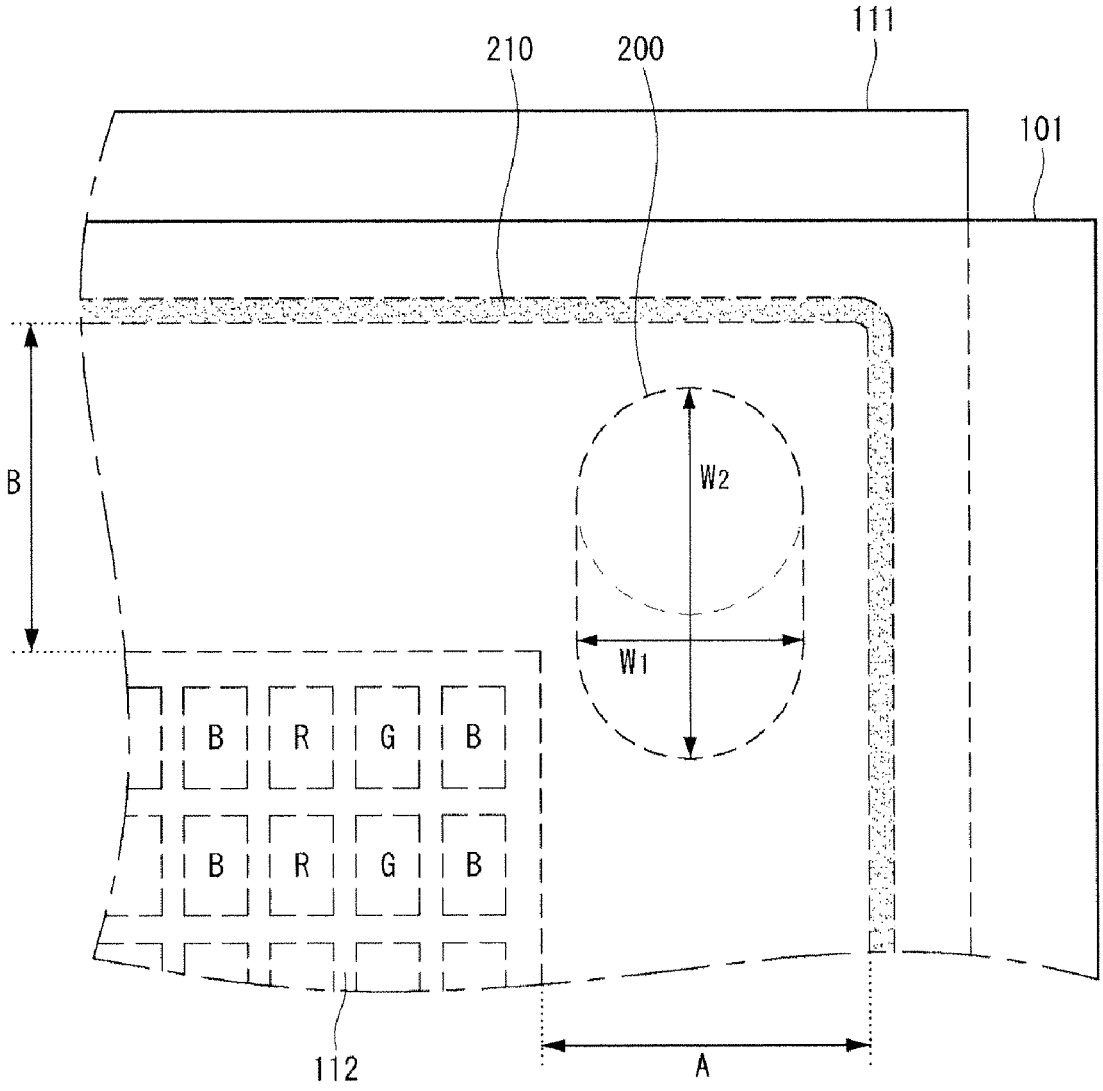

Alternatively, as shown in FIG. 19, a width W1 of the exhaust hole 200 along the longer side LS of the rear substrate 111 may be different from a width W2 of the exhaust hole 200 along the shorter side SS of the rear substrate 111 by increasing only the width W2 of the exhaust hole 200 in a state where the width W1 of the exhaust hole 200 is equal to a width (i.e., the diameter) of the exhaust hole 200 shown in FIG. 15. In this case, the bezel sizes in FIGS. 15 and 19 may be substantially equal to each other. However, because the size of the exhaust hole 200 in FIG. 19 is greater than the size of the exhaust hole 200 in FIG. 15, the exhaust characteristic in FIG. 19 may be further improved.

A shape of the exhaust hole 200 may vary depending on the formation location of the exhaust hole 200 on the rear substrate 111. For example, as shown in FIG. 20, when a distance S1 between the longer side LS of the rear substrate 111 and the exhaust hole 200 is less than a distance S2 between the shorter side SS of the rear substrate 111 and the exhaust hole 200, a length W1 of the exhaust hole 200 along the longer side LS of the rear substrate 111 may be greater than a length W2 of the exhaust hole 200 along the shorter side SS of the rear substrate 111.

Figure 21:
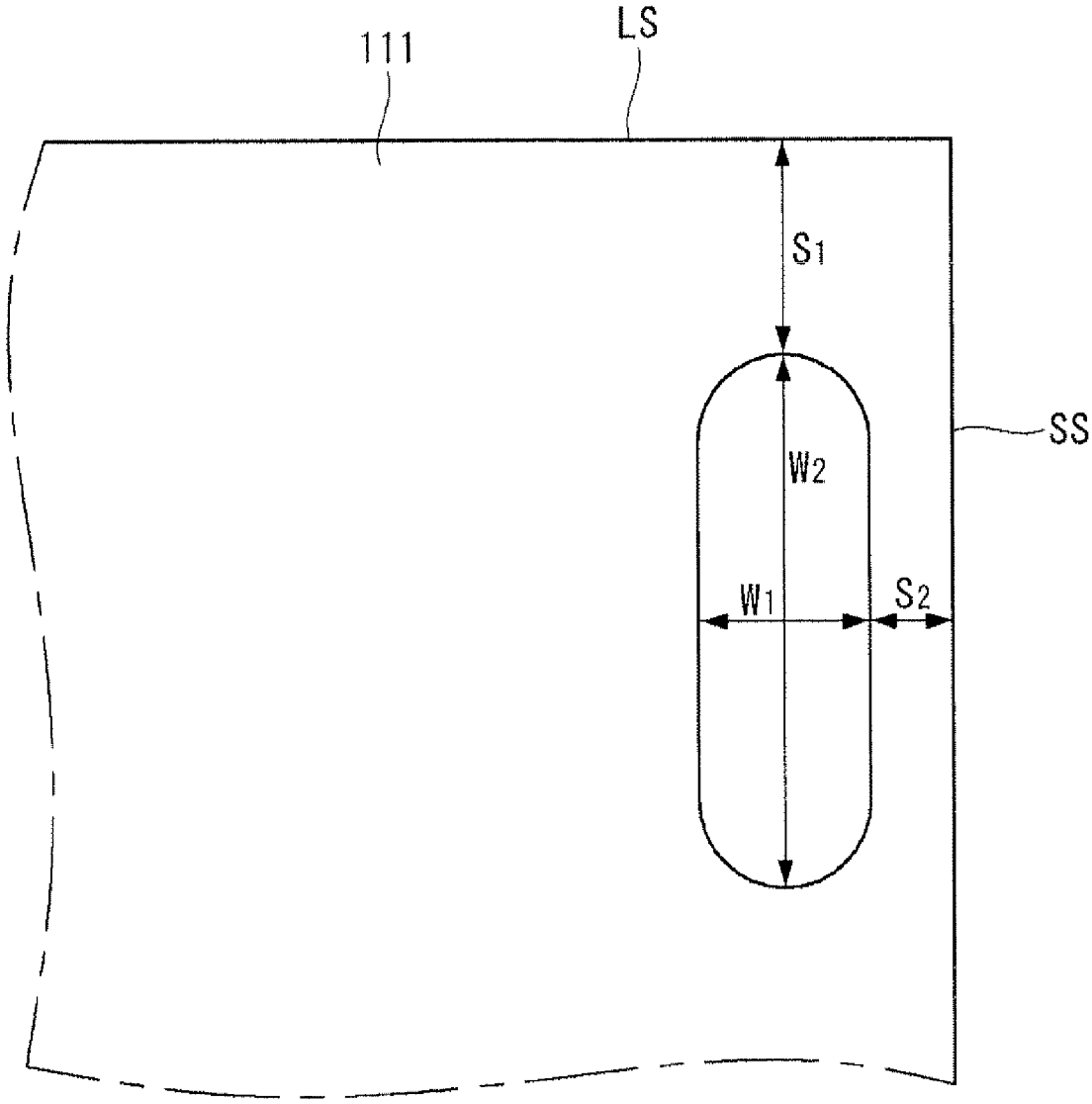

Alternatively, as shown in FIG. 21, when a distance S2 between the shorter side SS of the rear substrate 111 and the exhaust hole 200 is less than a distance S1 between the longer side LS of the rear substrate 111 and the exhaust hole 200, a length W2 of the exhaust hole 200 along the shorter side SS of the rear substrate 111 may be greater than a length W1 of the exhaust hole 200 along the longer side LS of the rear substrate 111.

Figure 20:
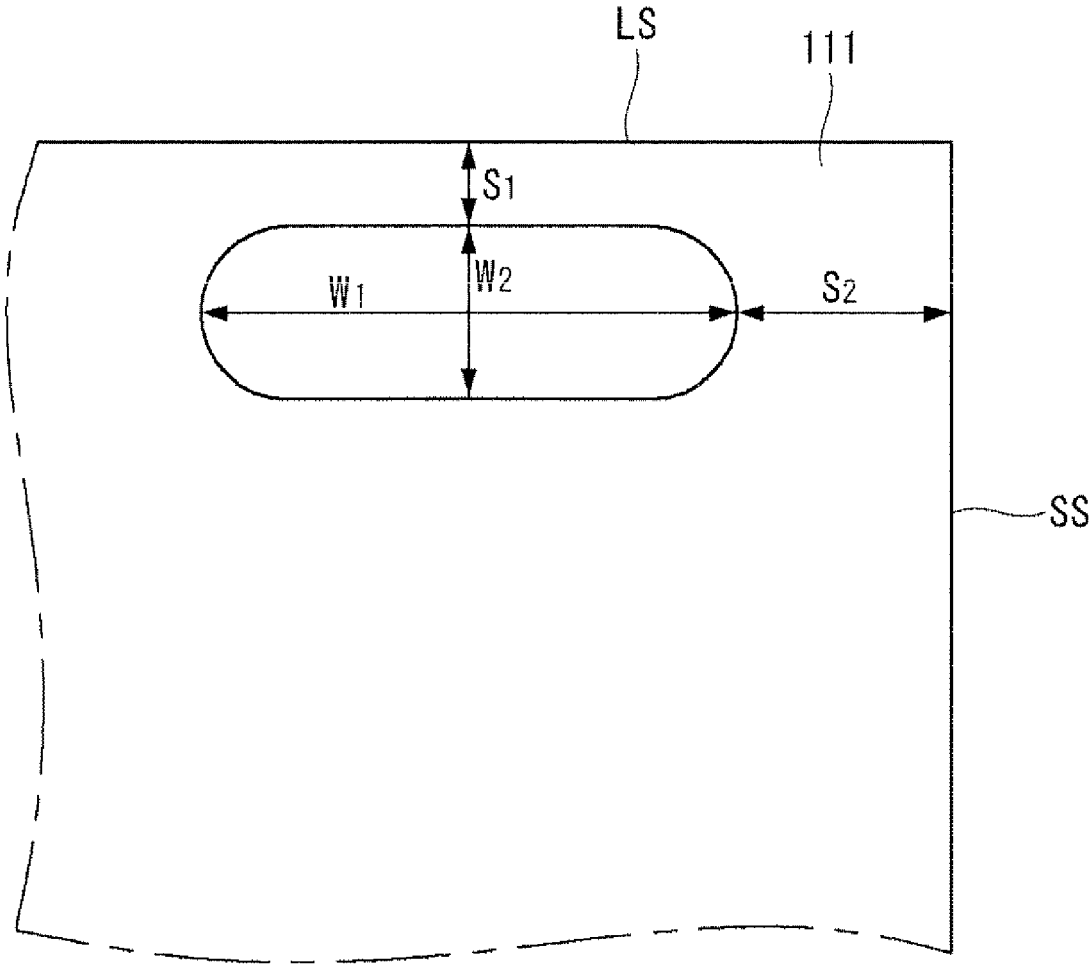

When the exhaust hole 200 is formed in a manner illustrated in FIGS. 20 and 21, the exhaust characteristic may be improved by widening the size of the exhaust hole 200 while relatively reducing the bezel size.

Figure 22:
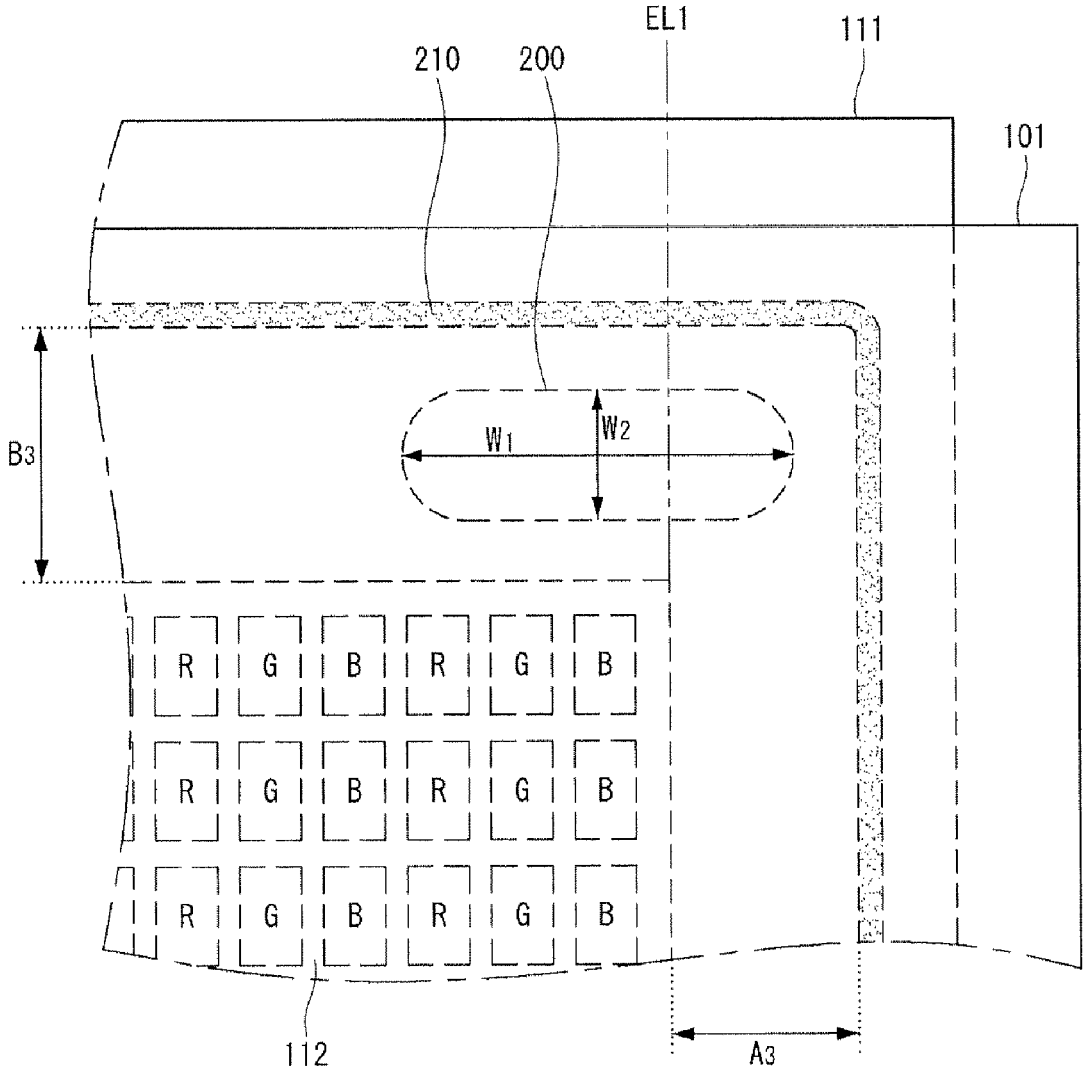

Further, the exhaust hole 200 may overlap an extension line EL1 of an outermost barrier rib 112 positioned along the shorter side SS of the rear substrate 111 as shown in FIG. 22, so as to sufficiently widen the size of the exhaust hole 200 on the rear substrate 111. In other words, a portion of the exhaust hole 200 may overlap at least one discharge cell along the longer side LS of the rear substrate 111. In this case, the bezel size may be further reduced by further reducing a distance A3 between the seal layer 210 and the barrier rib 112 along the longer side LS of the front substrate 101 or the rear substrate 111 while reducing a distance B3 between the seal layer 210 and the barrier rib 112 along the shorter side SS of the front substrate 101 or the rear substrate 111.

Figure 23:
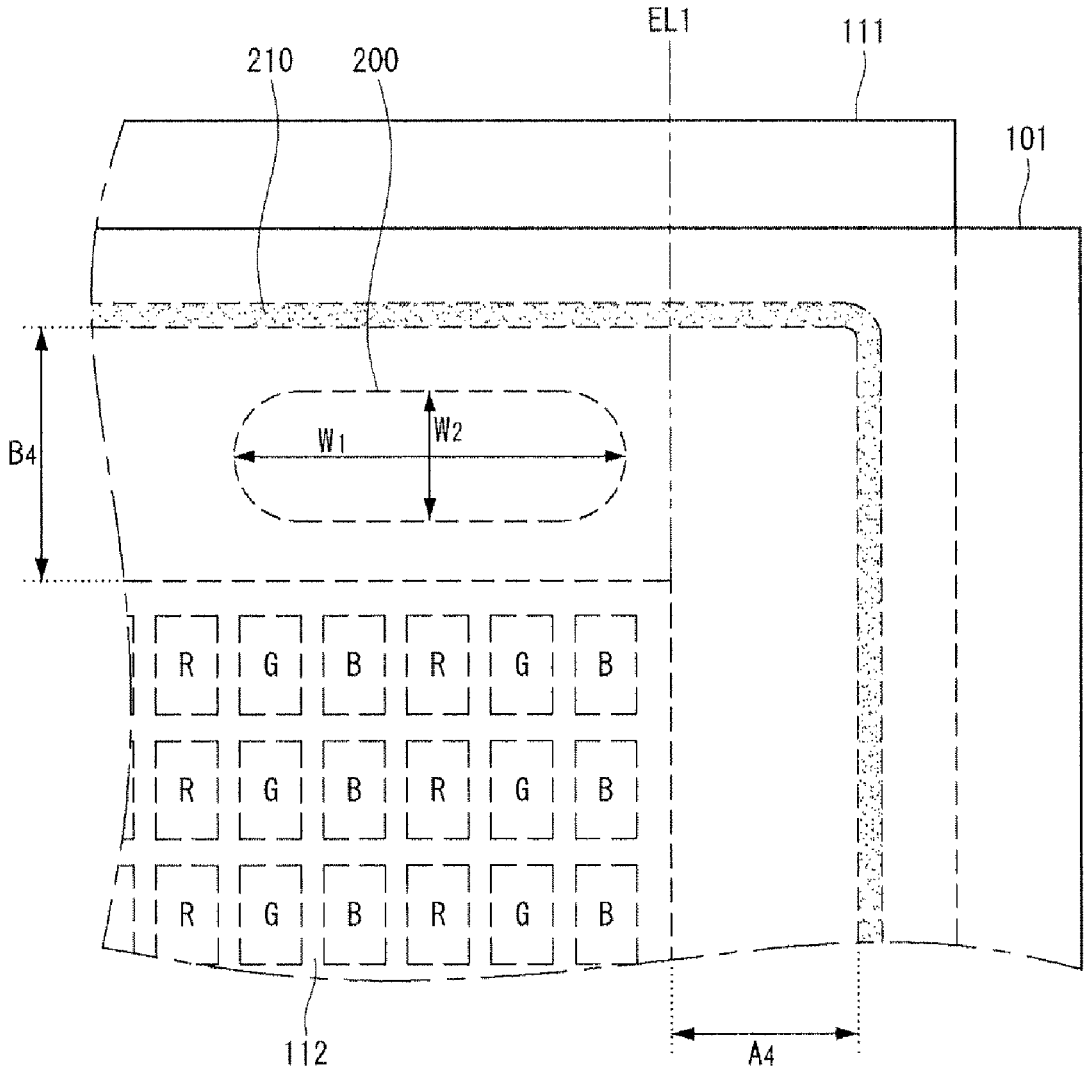

Alternatively, as shown in FIG. 23, the exhaust hole 200 may be positioned in a portion between extension lines EL1 of two outermost barrier ribs 112 positioned along the shorter side SS of the rear substrate 111. In other words, the entire exhaust hole 200 may overlap at least one discharge cell along the longer side LS of the rear substrate 111. In this case, the bezel size may be reduced.

Figure 24:
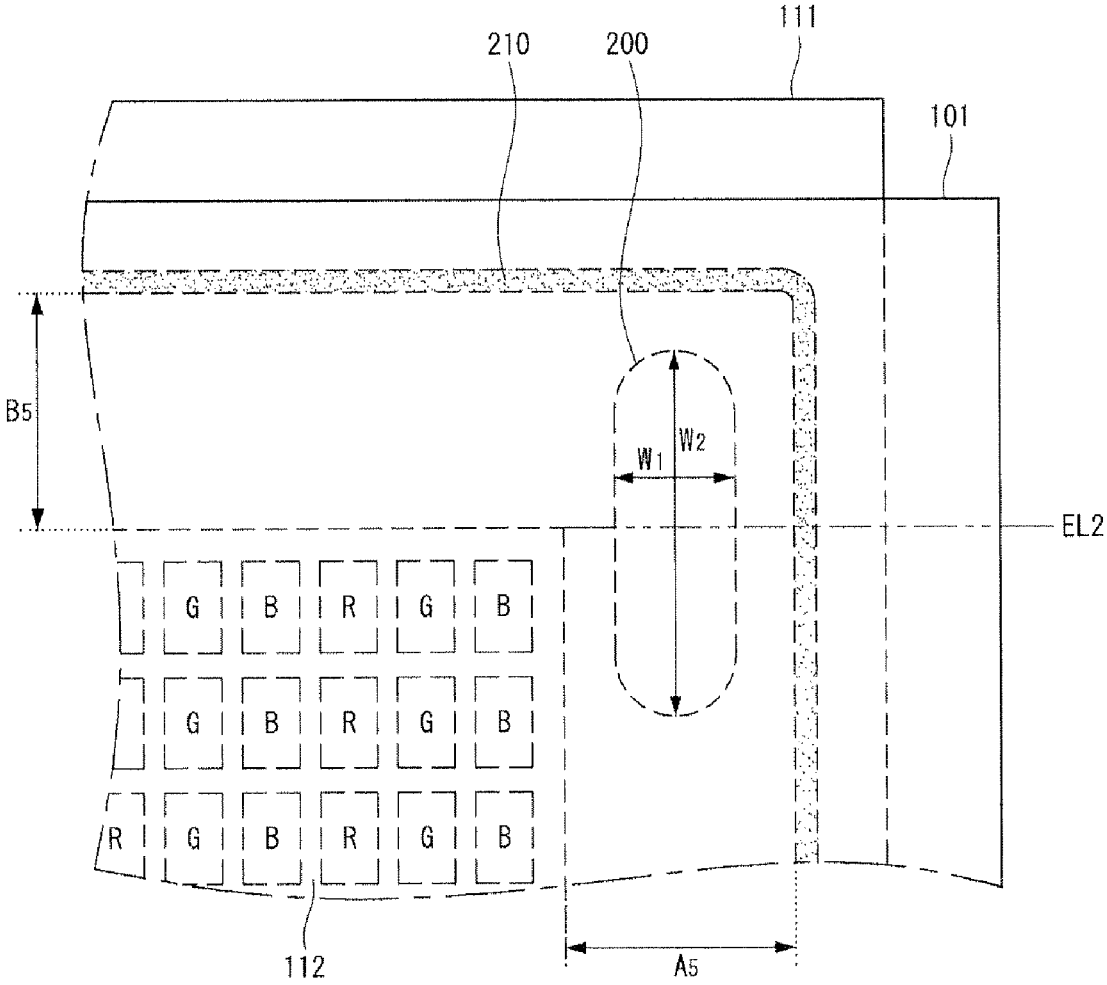

Alternatively, as shown in FIG. 24, the exhaust hole 200 may overlap an extension line EL2 of an outermost barrier rib 112 positioned along the longer side LS of the rear substrate 111. In other words, a portion of the exhaust hole 200 may overlap at least one discharge cell along the shorter side SS of the rear substrate 111.

Figure 25:
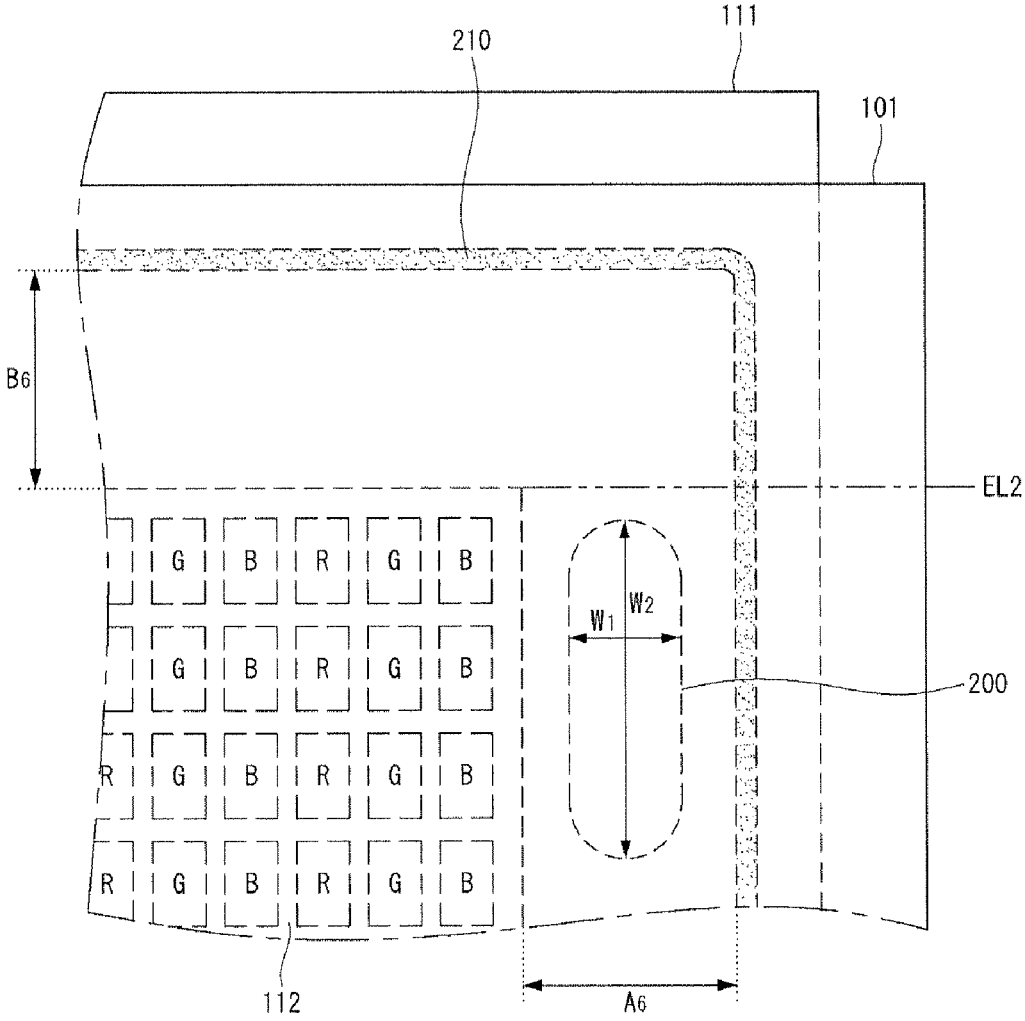

Alternatively, as shown in FIG. 25, the exhaust hole 200 may be positioned in a portion between extension lines EL2 of two outermost barrier ribs 112 positioned along the longer side LS of the rear substrate 111. In other words, the entire exhaust hole 200 may overlap at least one discharge cell along the shorter side SS of the rear substrate 111. In this case, the bezel size may be reduced.

FIGS. 26 to 29 illustrate a relationship between a first width and a second width of the exhaust hole 200.

Figure 26:
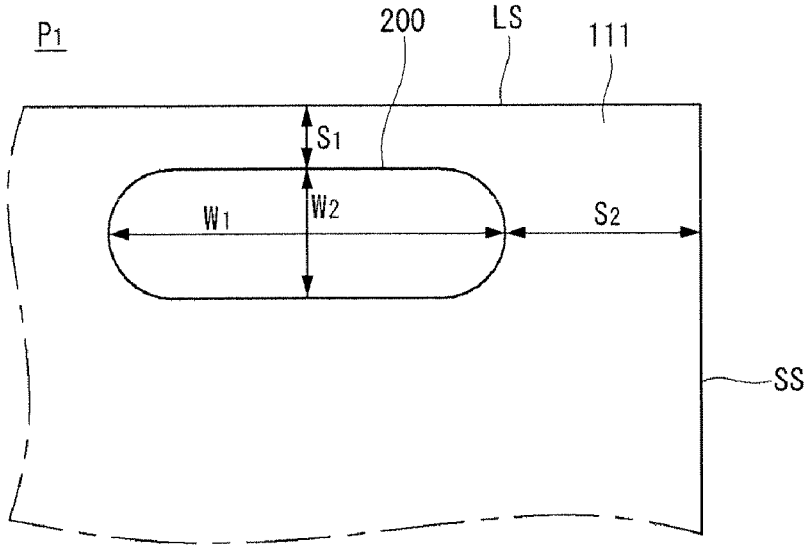
FIGS. 26 to 29 illustrate a relationship between a first width and a second width of an exhaust hole.
Figure 26:
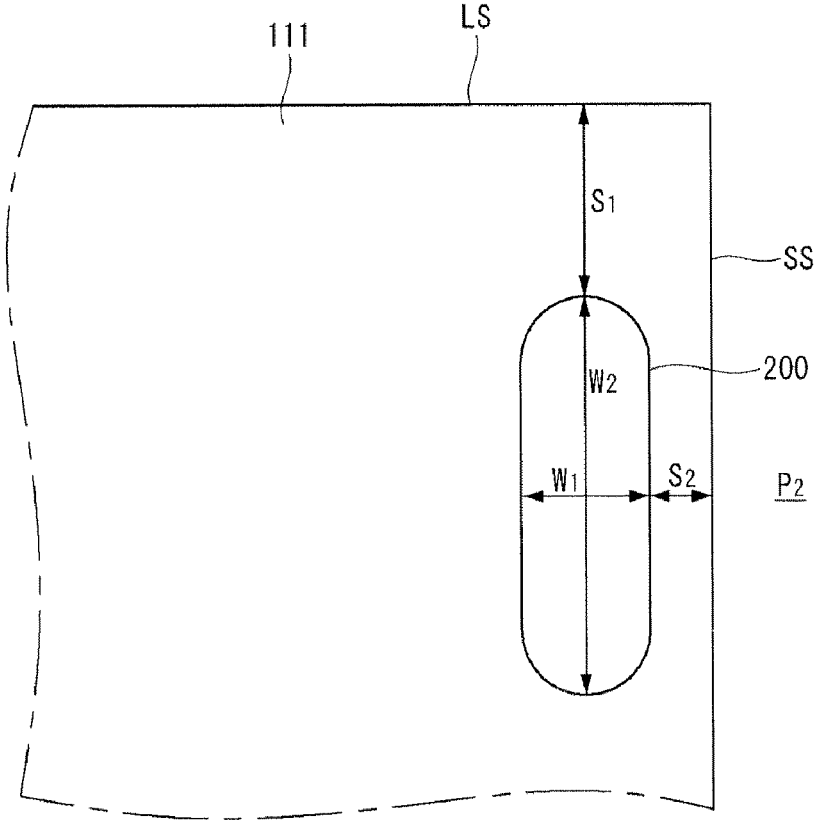

In each of a first structure in which the exhaust hole 200 is formed at a first position P1 as shown in (a) of FIG. 26 and a second structure in which the exhaust hole 200 is formed at a second position P2 as shown in (b) of FIG. 26, a gas in the panel was emitted using a vacuum pump, and time required to lower an internal pressure of the panel to a critical degree of vacuum was measured. The critical degree of vacuum was set to about $2.1\times10^{21}$ mmHg.

In the first structure, a distance S1 between the exhaust hole 200 at the first position P1 and the longer side LS of the rear substrate 111 is less than a distance S2 between the exhaust hole 200 at the first position P1 and the shorter side SS of the rear substrate 111. Further, in the second structure, a distance S1 between the exhaust hole 200 at the second position P2 and the longer side LS of the rear substrate 111 is greater than a distance S2 between the exhaust hole 200 at the second position P2 and the shorter side SS of the rear substrate 111.

In FIG. 26, a first width W1 of the exhaust hole 200 along the longer side LS of the rear substrate 111 is different from a second width W2 of the exhaust hole 200 along the shorter side SS of the rear substrate 111.

Figure 27:
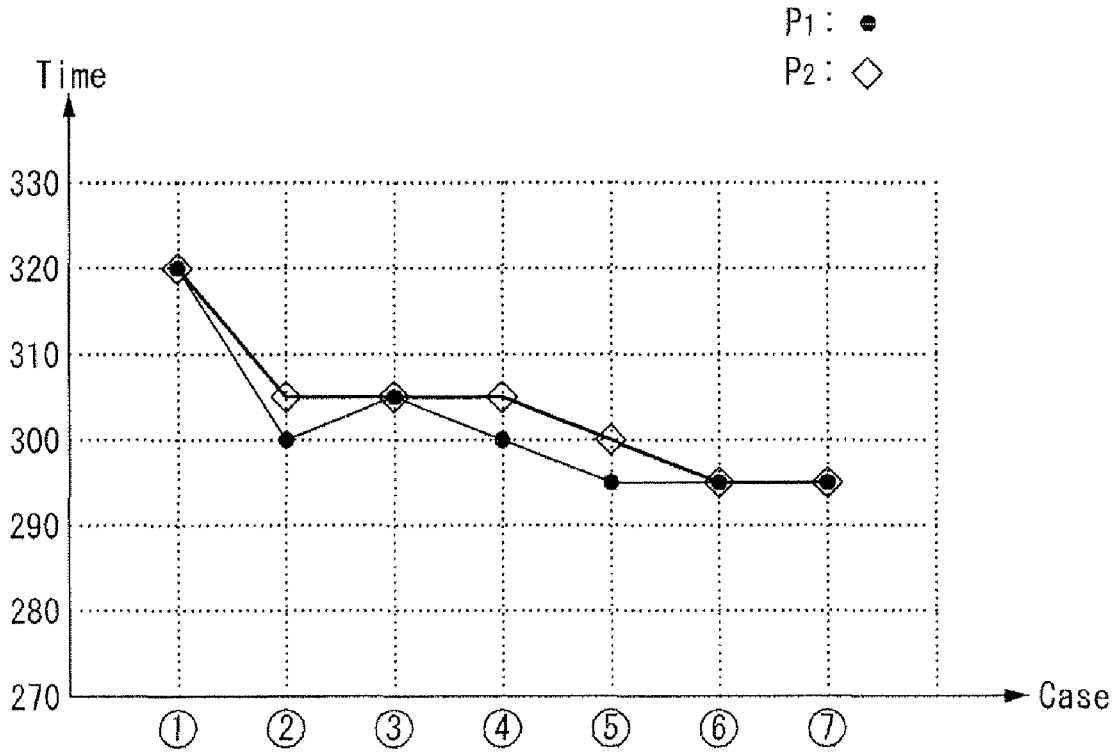

FIG. 27 is a graph measuring the time required to lower the internal pressure of the panel to the critical degree of vacuum when each of a ratio of the first width W1 to the second width W2 of the exhaust hole 200 at the first position P1 and a ratio of the second width W2 to the first width W1 of the exhaust hole 200 at the second position P2 was 1.1:1, 1.3:1, 1.6:1, 2.5:1, 3.5:1, 4.0:1, and 5.0:1.

As shown in FIG. 27, in a case ① where the ratio W1:W2 at the first position P1 was 1.1:1, the time required to lower the internal pressure of the panel to the critical degree of vacuum was about 320 minutes. In a case ② where the ratio W1:W2 at the first position P1 was 1.3:1, the time required to lower the internal pressure of the panel to the critical degree of vacuum was reduced to about 300 minutes. In a case ③ where the ratio W1:W2 at the first position P1 was 1.6:1, the time required to lower the internal pressure of the panel to the critical degree of vacuum was about 305 minutes. In a case ③ where the ratio W1:W2 at the first position P1 was 2.5:1, the time required to lower the internal pressure of the panel to the critical degree of vacuum was about 300 minutes. In cases ⑤, ⑥, and ⑦ where the ratio W1:W2 at the first position P1 was 3.5:1, 4.0:1, and 5.0:1, respectively, the time required to lower the internal pressure of the panel to the critical degree of vacuum was about 295 minutes.

Figure 28:
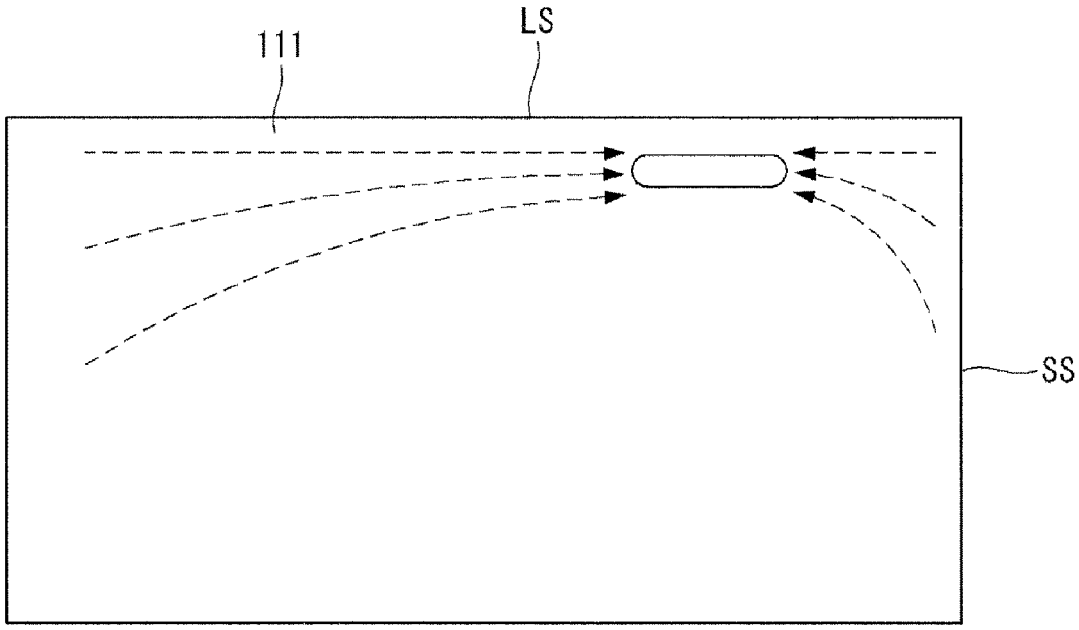
Figure 28:
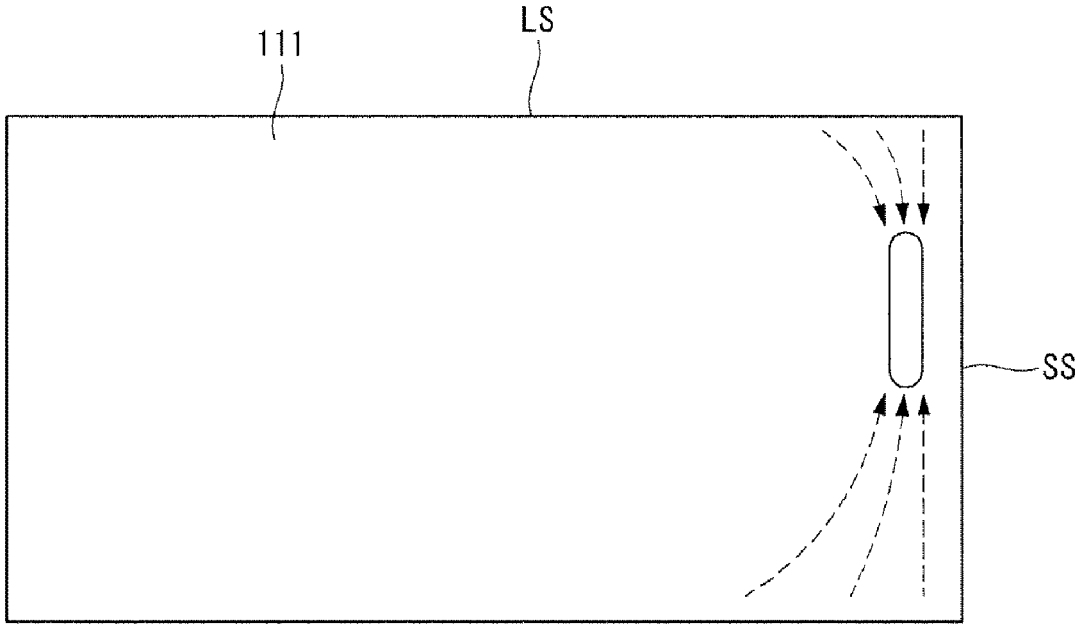

As above, a reason why the time required in the case ① is longer than the time required in the cases ②, ③, ④, ⑤, ⑥, and ⑦ is that the first width W1 of the exhaust hole 200 at the first position P1 increases along the longer side LS of the rear substrate 111 as shown in (a) of FIG. 28. Hence, the exhaust hole 200 may more efficiently suck the gas inside the panel through the shape of the exhaust hole 200 at the first position P1.

Further, as shown in FIG. 27, in a case ① where the ratio W2:W1 at the second position P2 was 1.1:1, the time required to lower the internal pressure of the panel to the critical degree of vacuum was about 320 minutes. In a case ② where the ratio W2:W1 at the second position P2 was 1.3:1, the time required to lower the internal pressure of the panel to the critical degree of vacuum was reduced to about 305 minutes. In cases ③ and ④ where the ratio W2:W1 at the second position P2 was 1.6:1 and 2.5:1, respectively, the time required to lower the internal pressure of the panel to the critical degree of vacuum was about 305 minutes. In a case ⑤ where the ratio W2:W1 at the second position P2 was 3.5:1, the time required to lower the internal pressure of the panel to the critical degree of vacuum was about 300 minutes. In cases ⑥ and ⑦ where the ratio W2:W1 at the second position P2 was 4.0:1 and 5.0:1, respectively, the time required to lower the internal pressure of the panel to the critical degree of vacuum was about 295 minutes.

As above, a reason why the time required in the case ① is longer than the time required in the cases ②, ③, ④, ⑤, ⑥, and ⑦ is that the second width W2 of the exhaust hole 200 at the second position P2 increases along the shorter side SS of the rear substrate 111 as shown in (b) of FIG. 28. Hence, the exhaust hole 200 may more efficiently suck the gas inside the panel through the shape of the exhaust hole 200 at the second position P2.

The following Table 1 indicates facility of exhaust and injection processes of the exhaust hole 200 in each of the cases ①, ②, ③, ④, ⑤, ⑥ and ⑦. More specifically, the following Table 1 is a result obtained when many experimenters estimated a difficulty level of a process for forming an exhaust tip for the exhaust and injection processes and connecting the exhaust tip to the exhaust hole in each of the cases ①, ②, ③, ④, ⑤, ⑥ and ⑦. In the following Table 1, X and ○ represent bad and good states of the process facility, respectively.

TABLE 1

| | Process Facility | |
|---|---|---|
| Case | First position P1 | Second position P2 |
| ① | ○ | ○ |
| ② | ○ | ○ |
| ③ | ○ | ○ |
| ④ | ○ | ○ |
| ⑤ | ○ | ○ |
| ⑥ | ○ | ○ |
| ⑦ | X | X |

As indicated in Table 1, the process facility of each of the exhaust hole 200 at the first position P1 and the exhaust hole 200 at the second position P2 was good in each of the cases ①, ②, ③, ④, ⑤ and ⑥. On the other hand, the process facility of each of the exhaust hole 200 at the first position P1 and the exhaust hole 200 at the second position P2 was bad in the case ⑦.

Figure 29:
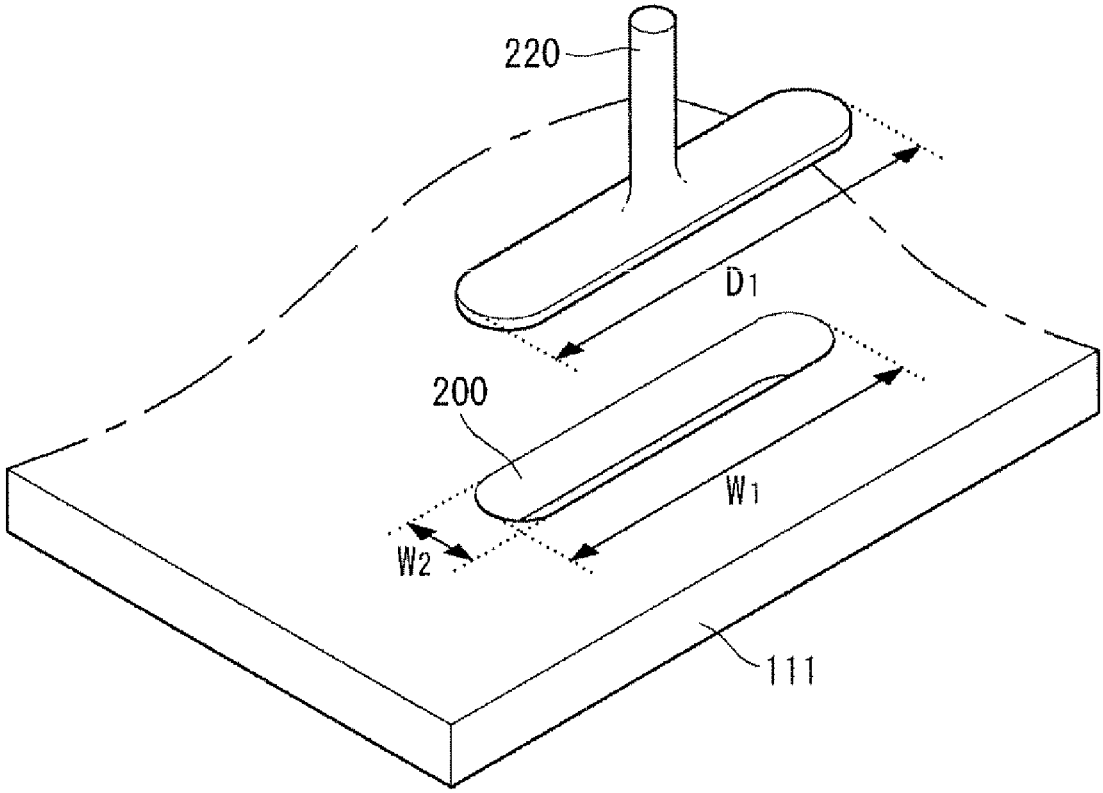

As an example corresponding to the case ⑦, as shown in FIG. 29, because the first width W1 of the exhaust hole 200 is excessively greater than the second width W2 of the exhaust hole 200, a width D1 of an exhaust tip 220 has to lengthen according to a shape of the exhaust hole 200 shown in FIG. 29.

In FIG. 29, it may be difficult to manufacture the exhaust tip 220, and also it may be relatively difficult to perform a process for connecting the exhaust tip 220 to the exhaust hole 200 and sealing the exhaust hole 200 with the exhaust tip 220. Further, the case illustrated in FIG. 29 may correspond to the case where the ratio W2:W1 is equal to or greater than 5.0:1, i.e., the case ⑦ at the second position P2.

Considering the descriptions of FIGS. 26 to 29 and the description of Table 1, when the exhaust hole 200 is formed at the first position P1 as shown in (a) of FIG. 26, it may be preferable that the ratio W1:W2 of the first width W1 to the second width W2 of the exhaust hole 200 at the first position P1 is approximately 1.3:1 to 4:1. Further, when the exhaust hole 200 is formed at the second position P2 as shown in (b) of FIG. 26, it may be preferable that the ratio W2:W1 of the second width W2 to the first width W1 of the exhaust hole 200 at the second position P2 is approximately 1.3:1 to 4:1.

Figure 30:
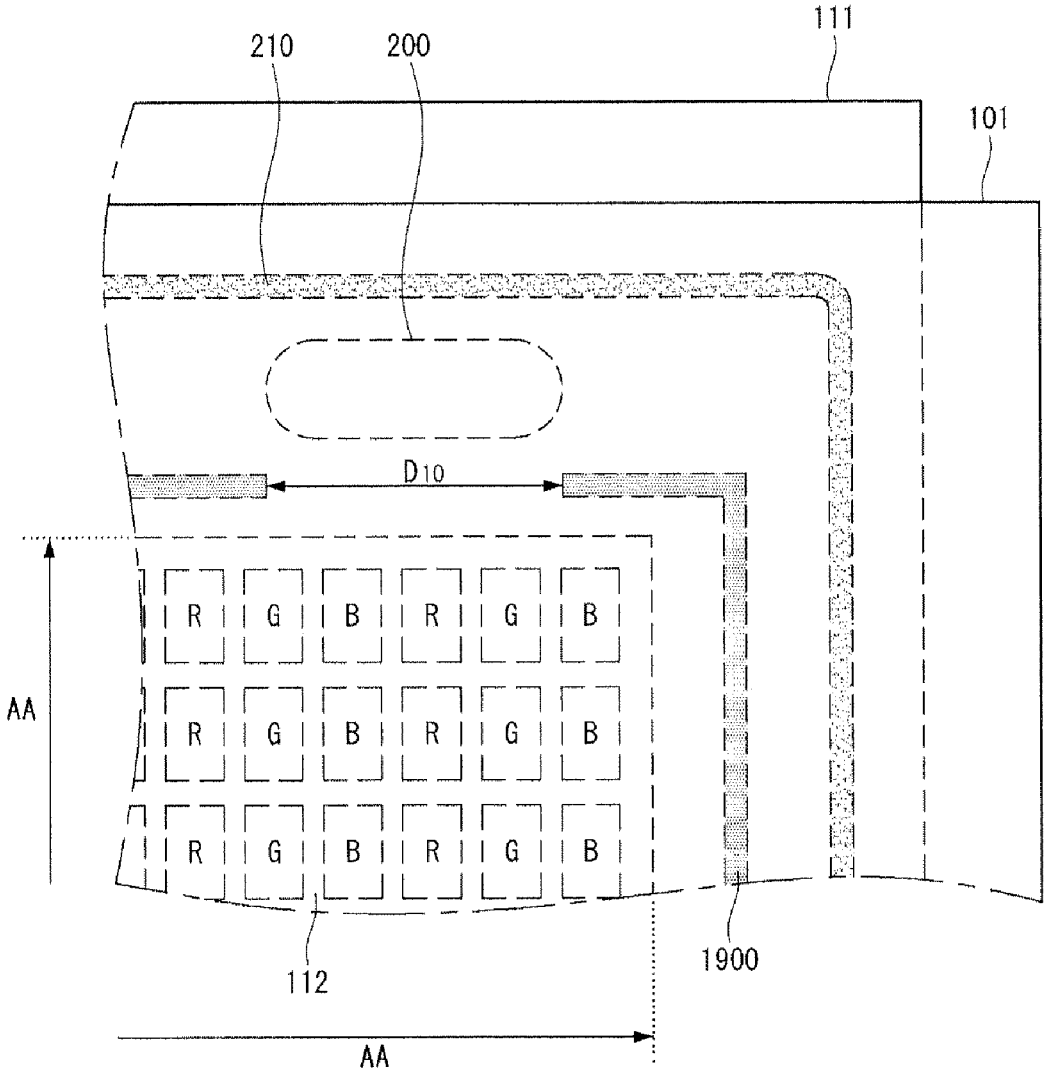
FIG. 30 illustrates a cutoff barrier rib.

FIG. 30 illustrates a cutoff barrier rib.

As shown in FIG. 30, a portion of a cutoff barrier rib 1900 between the exhaust hole 200 and the barrier rib 112 may be omitted. More specifically, when the exhaust hole 200 overlaps the active area AA along the longer side LS of the rear substrate 111, a portion of the cutoff barrier rib 1900 may be omitted in an overlapping portion D10 between the exhaust hole 200 and the cutoff barrier rib 1900 along the longer side LS of the rear substrate 111. As above, the gas may be injected more efficiently into the exhaust hole 200 by omitting the portion D10 of the cutoff barrier rib 1900, and thus a reduction in the exhaust characteristic of the exhaust hole 200 may be prevented.

Figure 31:
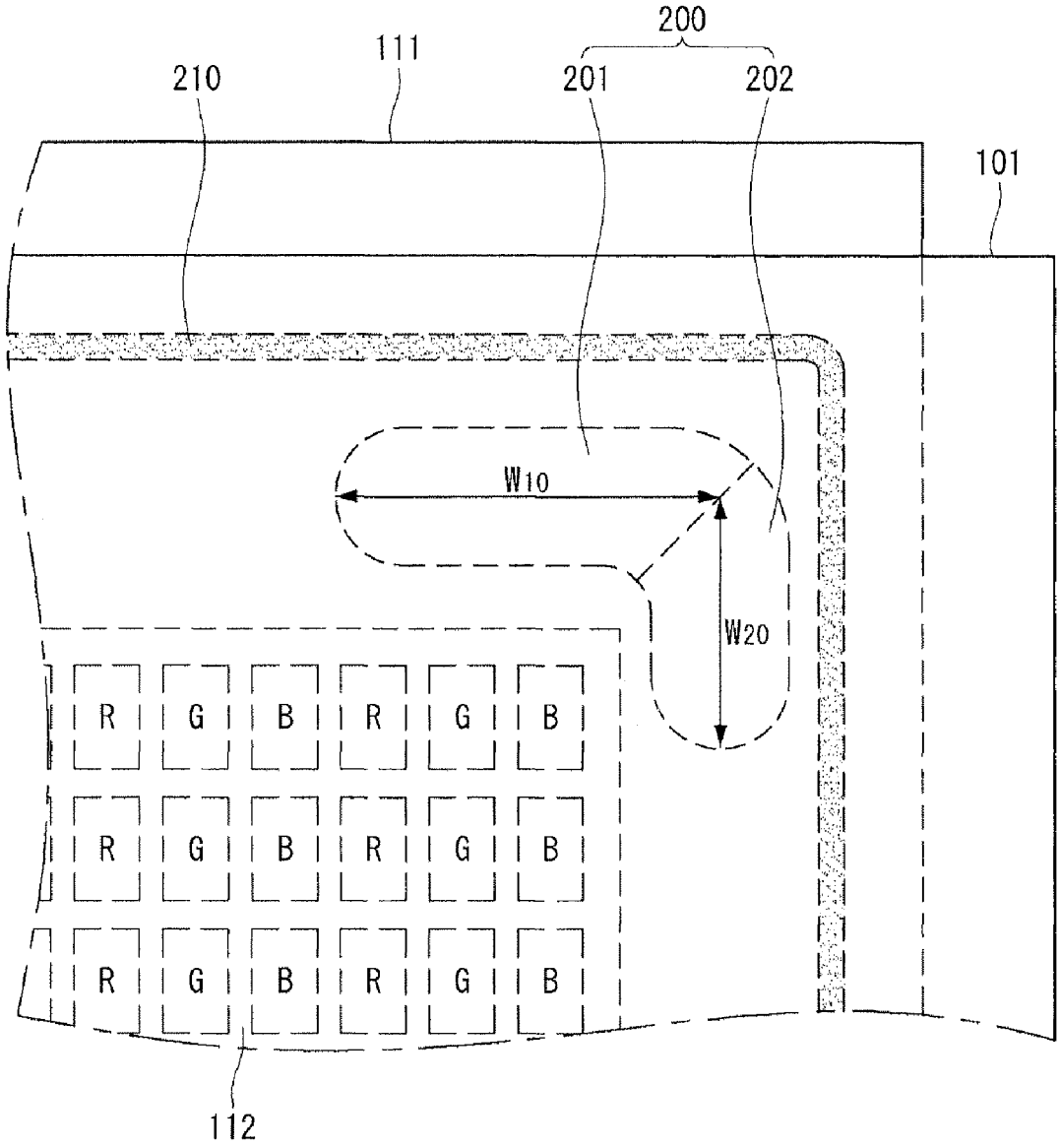
FIG. 31 illustrates another shape of an exhaust hole.

FIG. 31 illustrates another shape of the exhaust hole 200.

As shown in FIG. 31, the exhaust hole 200 may be formed at the corner of the rear substrate 111. The exhaust hole 200 may include a first portion 201 parallel to the longer side LS of the rear substrate 111 and a second portion 202 parallel to the shorter side SS of the rear substrate 111. The first portion 201 and the second portion 202 may have a crossing shape between the first portion 201 and the second portion 202. In this case, the bezel size may be reduced.

A length W10 of the first portion 201 may be longer than a length W20 of the second portion 202. As above, when the length W10 of the first portion 201 formed along the longer side LS of the rear substrate 111 is longer than the length W20 of the second portion 202 formed along the shorter side SS of the rear substrate 111, the exhaust characteristic of the exhaust hole 200 may be improved because a suction strength of the exhaust hole 200 along the longer side LS of the rear substrate 111, in which an amount of impurity gas to be emitted is more than that in the shorter side SS of the rear substrate 111, increases.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate;

a rear substrate opposite the front substrate;

a barrier rib that is positioned between the front substrate and the rear substrate to provide a discharge cell, the barrier rib including a first barrier rib and a second barrier rib that cross each other for partitioning the discharge cell;

a seal layer that attaches the front substrate to the rear substrate; and an exhaust hole that is formed on the rear substrate in a portion between the barrier rib and the seal layer, the exhaust hole being positioned in a portion that overlaps the discharge cell partitioned by the first barrier rib and the second barrier rib along a shorter side of the rear substrate, wherein a gap between the seal layer and an outermost barrier rib of barrier ribs positioned parallel to the shorter side of the rear substrate is less than a gap between the seal layer and an outermost barrier rib of barrier ribs positioned parallel to the longer side of the rear substrate.

2. The plasma display panel of claim 1, wherein the exhaust hole is positioned in a portion that overlaps an extension line of the outermost barrier rib of barrier ribs positioned parallel to the shorter side of the rear substrate.

3. The plasma display panel of claim 1, wherein the exhaust hole is positioned in a portion between extension lines of two outermost barrier ribs of barrier ribs positioned parallel to the shorter side of the rear substrate.

4. The plasma display panel of claim 1, further comprising a cutoff barrier rib positioned between the barrier rib and the seal layer and spaced apart from the barrier rib and the seal layer, wherein the exhaust hole is positioned in a portion between the seal layer and the cutoff barrier rib.

5. The plasma display panel of claim 4, wherein the cutoff barrier rib is divided in a portion between the exhaust hole and the barrier rib is omitted.

6. A plasma display panel comprising:

a front substrate;

a rear substrate opposite the front substrate;

a barrier rib positioned between the front substrate and the rear substrate to provide a discharge cell, the barrier rib including a first barrier rib and a second barrier rib that cross each other for partitioning the discharge cell;

a seal layer that attaches the front substrate to the rear substrate; and an exhaust hole that is formed on the rear substrate in a portion between the barrier rib and the seal layer, a length of the exhaust hole along a longer side of the rear substrate is different from a length of the exhaust hole along a shorter side of the rear substrate, and the exhaust hole is positioned in a portion that overlaps the discharge cell partitioned by the first barrier rib and the second barrier rib along the shorter side of the rear substrate, wherein a distance between the exhaust hole and the longer side of the rear substrate is less than a distance between the exhaust hole and the shorter side of the rear substrate, wherein the length of the exhaust hole along the longer side of the rear substrate is longer than the length of the exhaust hole along the shorter side of the rear substrate, wherein a gap between the seal layer and an outermost barrier rib of barrier ribs positioned parallel to the shorter side of the rear substrate is less than a gap between the seal layer and an outermost barrier rib of barrier ribs positioned parallel to the longer side of the rear substrate.

7. The plasma display panel of claim 6, wherein the exhaust hole has an oval shape.

8. The plasma display panel of claim 6, wherein the exhaust hole is positioned in a portion that overlaps an extension line of an outermost barrier rib positioned along the shorter side of the rear substrate.

9. The plasma display panel of claim 6, wherein the exhaust hole is positioned in a portion between extension lines of two outermost barrier ribs positioned along the shorter side of the rear substrate.

10. The plasma display panel of claim 6, wherein a ratio of the length of the exhaust hole along the longer side of the rear substrate to the length of the exhaust hole along the shorter side of the rear substrate is approximately 1.3:1 to 4:1.

* * * * *